US010593158B2

(12) United States Patent
Czyzewski et al.

(10) Patent No.: US 10,593,158 B2
(45) **Date of Patent: *Mar. 17, 2020**

(54) SYSTEMS AND METHODS OF LINKING GAMING STATIONS ADMINISTERING DIFFERENT WAGERING GAMES TO THE SAME PROGRESSIVE JACKPOT

(71) Applicant: SG Gaming, Inc., Las Vegas, NV (US)

(72) Inventors: Zbigniew Czyzewski, Henderson, NV (US); E. Damian Bless, Henderson, NV (US); Jeremy Halter, Las Vegas, NV (US)

(73) Assignee: SG Gaming, Inc., Las Vegas, NV (US)

( * ) Notice: Subject to any disclaimer, the term of this patent is extended or adjusted under 35 U.S.C. 154(b) by 6 days.

This patent is subject to a terminal disclaimer.

(21) Appl. No.: 15/987,503

(22) Filed: May 23, 2018

(65) Prior Publication Data

US 2018/0268656 A1 Sep. 20, 2018

Related U.S. Application Data

(62) Division of application No. 14/027,082, filed on Sep. 13, 2013, now Pat. No. 10,008,072.

(51) Int. Cl.
*G07F 17/32* (2006.01)
*G07F 17/34* (2006.01)

(52) U.S. Cl.
CPC ..... *G07F 17/3258* (2013.01); *G07F 17/34* (2013.01)

(58) Field of Classification Search
None
See application file for complete search history.

(56) References Cited

U.S. PATENT DOCUMENTS 5,116,055 A 5/1992 Tracy et al.
5,361,105 A 11/1994 Lu
(Continued)

FOREIGN PATENT DOCUMENTS

EP 1554021 A2 7/2005
EP 1640044 A1 3/2006
(Continued)

OTHER PUBLICATIONS

Australian Examiner's Report from Australian Application No. 2014318096, dated Mar. 6, 2019, 4 pages.
(Continued)

*Primary Examiner* — Robert T Clarke, Jr.
(74) *Attorney, Agent, or Firm* — TraskBritt

(57) ABSTRACT

Systems and methods of operating a major progressive jackpot linked to wagering games having different jackpot triggers with different probabilities. The major jackpot winning probabilities may be normalized such that players may have the substantially the same odds to win the major progressive jackpot regardless on the wagering game being played. During game play, the gaming stations may be randomly selected to participate for a chance to win the major progressive jackpot according to an eligibility probability, which may be inversely proportional to the probability of a jackpot trigger for the wagering game administered by the gaming station. Players may be informed of whether the current round of game play is eligible for the major progressive jackpot after wagers are placed and before the current round of game play.

10 Claims, 12 Drawing Sheets

(56) References Cited

U.S. PATENT DOCUMENTS 5,364,104 A 11/1994 Jones et al.
5,472,194 A 12/1995 Breeding et al.
5,486,005 A 1/1996 Neal et al.
5,584,485 A 12/1996 Jones et al.
5,707,285 A 1/1998 Place et al.
5,743,800 A 4/1998 Huard et al.
5,855,515 A 1/1999 Pease et al.
5,911,418 A 6/1999 Adams
6,019,374 A 2/2000 Breeding
6,139,430 A 10/2000 Huard et al.
6,146,270 A 11/2000 Huard et al.
6,217,448 B1 4/2001 Olsen
6,241,608 B1 6/2001 Torango
6,299,534 B1 10/2001 Breeding et al.
6,312,332 B1 11/2001 Walker et al.
6,435,968 B1 8/2002 Torango
6,592,460 B2 7/2003 Torango
6,656,048 B2 12/2003 Olsen
6,733,390 B2 5/2004 Walker et al.
6,743,094 B2 6/2004 Johnson
6,755,741 B1 6/2004 Rafaeli
6,916,245 B1 7/2005 Vancura et al.
7,008,324 B1 3/2006 Johnson et al.
7,008,357 B2 3/2006 Winkler
7,056,215 B1 6/2006 Olive
7,070,505 B2 7/2006 Vancura et al.
7,077,746 B2 7/2006 Torango
7,108,603 B2 9/2006 Olive
7,255,645 B2 8/2007 Steil et al.
7,297,059 B2 11/2007 Vancura et al.
7,367,884 B2 5/2008 Breeding et al.
7,384,336 B2 6/2008 Torango
7,566,274 B2 7/2009 Johnson et al.
7,568,973 B2 8/2009 Iddings et al.
7,575,516 B2 8/2009 Olive
7,582,014 B2 9/2009 Olive
7,585,223 B2 9/2009 Iddings et al.
7,614,948 B2 11/2009 Saffan et al.
7,625,283 B2 12/2009 Olive
7,651,394 B2 1/2010 Johnson
7,661,676 B2 2/2010 Smith et al.
7,780,520 B2 8/2010 Baerlocher
7,789,756 B2 9/2010 Jones
7,862,427 B2 1/2011 Nguyen et al.
7,914,377 B2 3/2011 Benbrahim et al.
7,931,532 B2 4/2011 Johnson
7,951,004 B2 5/2011 Saffari et al.
7,959,509 B2 6/2011 Saffari et al.
7,963,847 B2 6/2011 Baerlocher
8,016,679 B2 9/2011 Steil et al.
8,070,574 B2 12/2011 Grauzer et al.
8,075,384 B2 12/2011 Jones
8,109,821 B2 2/2012 Kovacs et al.
8,128,491 B2 3/2012 Vasquez et al.
8,128,492 B2 3/2012 Vasquez et al.
8,137,188 B2 3/2012 Breckner et al.
8,147,320 B2 4/2012 Englman et al.
8,192,279 B2 6/2012 Saffari et al.
8,202,160 B2 6/2012 Englman et al.
8,251,803 B2 8/2012 Nelson
8,262,475 B2 9/2012 Snow et al.
8,272,958 B2 9/2012 Smith et al.
8,360,851 B2 1/2013 Aoki et al.
8,403,740 B2 3/2013 Kovacs et al.
8,444,476 B2 5/2013 Johnson
8,449,387 B2 5/2013 Englman et al.
8,506,392 B2 8/2013 Jaffe
8,512,130 B2 8/2013 Muir
8,523,661 B2 9/2013 Pires
8,535,141 B2 9/2013 Rommerdahl
8,579,709 B2 11/2013 Saffari et al.
8,613,650 B2 12/2013 Kovacs et al.
8,628,398 B2 1/2014 Ellis
8,628,410 B2 1/2014 Jaffe et al.
8,636,586 B2 1/2014 Olive
8,636,597 B2 1/2014 Steil et al.
8,663,000 B2 3/2014 Olive
8,684,832 B2 4/2014 Saffari et al.
8,702,488 B2 4/2014 Vasquez et al.
8,747,210 B2 6/2014 Kennedy
8,758,123 B2 6/2014 Frattinger et al.
8,834,259 B2 9/2014 Rommerdahl
8,961,298 B2 2/2015 Czyzewski et al.
8,992,323 B2 3/2015 Kelly et al.
9,269,228 B2 2/2016 Muir
9,412,241 B2 8/2016 Olive
9,558,631 B2 1/2017 Olive
9,704,339 B2 7/2017 Olive
9,898,891 B2 2/2018 Muir
10,204,486 B2 2/2019 Van et al.
10,332,348 B2 6/2019 Halter et al.
2003/0011127 A1 1/2003 Vancura et al.
2003/0232640 A1 12/2003 Walker
2004/0038735 A1* 2/2004 Steil ..... G07F 17/32 463/27
2004/0087357 A1 5/2004 Johnson
2004/0152511 A1 8/2004 Nicely et al.
2005/0096130 A1 5/2005 Mullins
2005/0164759 A1 7/2005 Smith et al.
2005/0164762 A1 7/2005 Smith et al.
2005/0239542 A1 10/2005 Olsen
2006/0135254 A1 6/2006 Thomas
2006/0142079 A1 6/2006 Ikehara et al.
2007/0111786 A1 5/2007 Snow
2007/0191088 A1 8/2007 Breckner et al.
2007/0298873 A1 12/2007 Nguyen
2008/0020830 A1 1/2008 Ikehara et al.
2008/0020831 A1 1/2008 Ikehara et al.
2008/0108429 A1 5/2008 Davis et al.
2008/0113765 A1 5/2008 DeWaal
2008/0161105 A1 7/2008 Mishra
2008/0254854 A1 10/2008 Slomiany et al.
2008/0287185 A1 11/2008 Yoseloff et al.
2009/0124364 A1 5/2009 Cuddy
2009/0131159 A1 5/2009 Englman et al.
2009/0203422 A1 8/2009 Ellis
2009/0270168 A1 10/2009 Englman et al.
2009/0298574 A1 12/2009 Gauselmann
2010/0081497 A1 4/2010 Wolf
2010/0087246 A1 4/2010 Ward
2010/0120495 A1 5/2010 Frank et al.
2010/0216532 A1 8/2010 Halverson
2011/0014969 A1 1/2011 Nicely
2011/0130192 A1 6/2011 Englman et al.
2011/0263320 A1 10/2011 Tara
2012/0115594 A1 5/2012 Hornik et al.
2012/0122551 A1 5/2012 Soltys et al.
2012/0165092 A1 6/2012 Saffari et al.
2013/0053117 A1 2/2013 Snow
2013/0137506 A1 5/2013 Low et al.
2013/0157752 A1 6/2013 Yoseloff
2013/0184056 A1 7/2013 Jaffe et al.
2013/0184059 A1 7/2013 Costello et al.
2013/0184079 A1 7/2013 Costello et al.
2013/0244766 A1 9/2013 Jaffe
2013/0274005 A1 10/2013 Englman et al.
2013/0296025 A1 11/2013 Castle et al.
2013/0310165 A1 11/2013 Witty et al.
2014/0045581 A1 2/2014 Pires
2014/0073412 A1 3/2014 Kovacs et al.
2014/0094293 A1 4/2014 Nicely
2014/0106872 A1 4/2014 Steil et al.
2014/0113712 A1 4/2014 Van Asdale
2014/0213348 A1 7/2014 Vasquez et al.

FOREIGN PATENT DOCUMENTS

JP 2002000939 A 1/2002
WO 3063019 A1 7/2003
WO 2007128033 A1 11/2007
WO 2007146693 A2 12/2007
WO 2008/024556 A3 2/2008
WO 2008030904 A2 3/2008

(56) References Cited

FOREIGN PATENT DOCUMENTS

| | | | |
|---|---|---|---|
| WO | 2009/017590 | A2 | 2/2009 |
| WO | 2009/114472 | A1 | 9/2009 |
| WO | 2012100286 | A1 | 8/2012 |

OTHER PUBLICATIONS

Australian Examiner's Report from Australian Application No. 2014318096, dated Aug. 18, 2018, 4 pages.
Australian Examination Report from Australian Application No. 2014318096, dated Apr. 26, 2018, 2 pages.
PCT International Preliminary Report on Patentability for PCT/US2014/054357, dated Mar. 15, 2016, 20 pages.
PCT International Search Report and Written Opinion of the International Searching Authority for PCT/US2014/054357, dated Feb. 6, 2015, 23 pages.
Chinese Office Action and Search Report from Chinese Application No. 201480060743.6, dated Sep. 7, 2018, 10 pages.

* cited by examiner

SYSTEMS AND METHODS OF LINKING GAMING STATIONS ADMINISTERING DIFFERENT WAGERING GAMES TO THE SAME PROGRESSIVE JACKPOT

CROSS-REFERENCE TO RELATED APPLICATION

This application is a divisional of U.S. patent application Ser. No. 14/027,082, filed Sep. 13, 2013, now U.S. Pat. No. 10,008,072, issued Jun. 26, 2018 the disclosure of which is hereby incorporated herein in its entirety by this reference.

FIELD

Embodiments of the present disclosure relate to wagering games having at least one associated progressive jackpot.

BACKGROUND

The use of progressive jackpots in casino games is well known in the art. Wagering games employing progressive jackpots conventionally include an amount of money to be won if a predetermined event or condition to trigger a payout from a progressive jackpot occurs in a wagering game. The amount of money to be won is traditionally displayed on an incrementing jackpot meter or display. The predetermined event or condition may be time-based, game-based, randomly determined or otherwise. For each wagering game (e.g., at the beginning or end of the wagering game, for each round of the wagering game played, etc.) a portion of the wager may be added to the progressive jackpot. This wager is typically an optional side bet wager that is fixed in amount and is made on an electronic coin spot sensor. As a result, the amount of money to be won with the progressive jackpot may increase for each wagering game played. The increases may be shown on the jackpot meter or display.

Multiple gaming stations of the same type (e.g., multiple gaming tables, multiple slot machines, etc.) that offer the same wagering game are sometimes linked to a common progressive jackpot. The common progressive jackpot may cause the amount of money to be won with the progressive jackpot to increase more quickly, which may result in higher progressive jackpots depending upon the probability of occurrence of a jackpot trigger. Higher progressive jackpots may add appeal to a wagering game, and may result in more wagering games played, or rounds of wagering games played.

Operating a progressive jackpot system including multiple gaming stations that are all configured to administer the same wagering game may be relatively simple because the probability of the jackpot trigger at each of the gaming stations is the same. For example, multiple blackjack tables may each be linked to the same progressive jackpot, and each contributes a portion of its side bets to the same progressive jackpot. A player at any of the blackjack tables may win the progressive jackpot responsive to achieving a jackpot trigger such as a premium hand (such as five (5) Ace of Spades, for example) at their blackjack table.

Linking multiple gaming stations that host different wagering games may further accelerate an increase in the progressive jackpot in a given amount of time. Some conventional progressive jackpot systems link multiple gaming stations that are configured to host different wagering games with different probabilities of jackpot triggers. One such example is described in U.S. Pat. No. 7,297,059 to Vancura et al., which describes a system that determines a fractional portion of a progressive jackpot to be awarded when a jackpot trigger occurs. The fractional portion that is awarded is based on the size of a wager; however, the probability of winning the progressive jackpot may be different at different gaming stations.

Another example of a conventional progressive jackpot system that links multiple gaming stations configured to host different wagering games with different jackpot win probabilities is described in U.S. Pat. No. 5,855,515 to Pease et al., which describes randomly selecting a gaming station to participate in the progressive jackpot. If a group that the selected gaming station belongs to has contributed a threshold amount to the progressive jackpot, then a random number generator is used to determine if a player at the selected gaming station wins the progressive jackpot. The described system, therefore, removes the jackpot trigger element from the progressive jackpot system.

BRIEF SUMMARY

Embodiments of the present disclosure include systems and methods of operating a progressive wagering game such that the probability that a current round of game play qualifies for winning a major progressive jackpot is equal among all gaming stations despite the gaming stations administering wagering games having game jackpot trigger probabilities that are dissimilar.

In some embodiments, the present disclosure comprises a progressive jackpot system. The progressive jackpot system comprises at least one processor programmed to link at least two gaming stations to a major progressive jackpot. The at least two gaming stations may be configured to administer at least two different wagering games that have different jackpot trigger probabilities for achieving a jackpot trigger for the major progressive jackpot. The at least one processor may be further programmed to normalize a major jackpot winning probability based, at least in part, on the different jackpot trigger probabilities such that the major jackpot winning probability for players of the at least two different wagering games is substantially the same.

In other embodiments, the present disclosure comprises a method for operating a progressive jackpot system. The method comprises providing a first gaming station administering a first wagering game with a first jackpot trigger probability of achieving a jackpot trigger, and providing a second gaming station administering a second wagering game with a second jackpot trigger probability of achieving a jackpot trigger, the first wagering game and the second wagering game being different. For example, a highest ranking hand of the first wagering game at the first gaming station and a highest ranking hand of the second wagering game at the second gaming station have different winning probabilities. The method further comprises assigning a first eligibility probability to the first wagering game for the first gaming station to be eligible to participate in a major progressive jackpot, assigning a second eligibility probability to the second wagering game for the second gaming station to be eligible to participate in the major progressive jackpot, and randomly determining whether at least one of the first gaming station and the second gaming station is eligible to participate in a major progressive jackpot based, at least in part, on the corresponding first and second eligibility probabilities.

In other embodiments, the present disclosure comprises a progressive jackpot system. The progressive jackpot system comprises at least one processor programmed to manage a major progressive jackpot for a plurality of linked gaming stations administering different wagering games, having different highest ranking hand win probabilities, and normalize a major jackpot winning probability to be substantially the same probability for each of the different wagering games to win the major progressive jackpot even though the different wagering games have jackpot triggers that have different jackpot trigger probabilities from each other.

In other embodiments, the present disclosure comprises a progressive jackpot system. The progressive jackpot system comprises a gaming station configured for administering a first wagering game having a first jackpot trigger with a first jackpot trigger probability. The gaming station comprises a playing surface, at least one player interface including an electronic display for at least one player position, a dealer interface, and at least one processor. The at least one processor is programmed to link the gaming station to a major progressive jackpot that is also linked with at least one other gaming station configured for administering a second wagering game having a second jackpot trigger with a second jackpot trigger probability that is different from the first jackpot trigger probability, and initiate a request for determining whether a current round of the first wagering game is eligible for participating in the major progressive jackpot according to an eligibility probability that is based, at least in part, on a desired jackpot winning probability and the first jackpot trigger probability.

In other embodiments, the present disclosure comprises a method of operating a progressive jackpot system. The method comprises receiving at a server authorization indicating a wager for a wagering game linked to a major progressive jackpot has been made, generating a random number, utilizing the random number to determine whether a current round of game play is eligible for the major progressive jackpot, wherein a determined probability that the current round of game play is eligible for the major progressive jackpot is approximately equal to a desired jackpot winning probability divided by a jackpot trigger probability, and distributing at least a portion of the major progressive jackpot responsive a jackpot trigger (e.g., a predetermined winning hand, such as a highest ranking hand for the wagering game) occurring during the current round when the current round is determined to be eligible for the major progressive.

In other embodiments, the present disclosure comprises a method of operating a progressive jackpot system. The method comprises allocating from a server a quantity of valueless wagering elements to at least one player at a gaming station to participate in a play-for-fun wagering game. The method includes receiving at least a portion of the valueless wagering elements as a major jackpot side wager, generating a random number, utilizing the random number to determine whether a current round of game play is eligible for a major progressive jackpot comprising valueless wagering elements, wherein a determined eligibility probability that the current round of game play is eligible for the major progressive jackpot is approximately equal to a desired jackpot winning probability divided by a jackpot trigger probability, and transferring the valueless wagering elements of the major progressive jackpot to the at least one player responsive to occurrence of a jackpot trigger while the current round is determined to be eligible for the major progressive jackpot.

Some embodiments of the present disclosure may be used in an online gaming environment. For example, in some embodiments, the present disclosure comprises a method of operating an online progressive jackpot system. The method comprises utilizing an online game server to link a plurality of gaming stations to a major progressive jackpot, receiving at the game server authorization from each player to receive an optional side bet to win at least one of a first progressive jackpot and a major progressive jackpot, the first and major progressive jackpots having different probabilities of winning a top prize, the game server generating a random number indicating whether the gaming station is eligible to win a major jackpot; and awarding a top prize to the player when the gaming station is eligible and the player has achieved a predetermined winning top prize. In this embodiment, the determined a jackpot winning probability has been normalized for each gaming station of the plurality of gaming stations by utilizing dissimilar eligibility probabilities for each gaming station participating in the major progressive jackpot.

Further embodiments may include one, some, or all of the following: The acts of the dealer may be carried out by a visual representation of a dealer, the visual representation being generated and/or displayed by a computer. The visual representation may be a virtual person (e.g., an animation), or may be a transmission (e.g., a video) of an actual person. The visual representation may be part of an online gaming experience of the disclosed game. The acts described in this disclosure associated with a dealer, including dealing cards, displaying or turning cards over, receiving or paying bets, or any other actions, may be represented in any way when used in an online environment. For example, the cards associated with a dealer action, described as being dealt or otherwise handled by a dealer, may appear as virtual cards or as transmitted pictures of physical cards. This may include a display of virtual card decks where each deck, individual card, and hand is displayed to an online player in a manner consistent with the game play disclosed herein, but may or may not include a visual representation of a dealer with the cards. Likewise, betting activity may be displayed in any manner to a player, including, but not limited to, virtual chips, betting pools, numbers, or other indicia of a bet amount.

The online experience may involve players playing remotely (e.g., in a different physical location) from the dealer, remotely from the location of a game server, or remotely from both, interacting through a networked connection that may include, but is not limited to, the Internet. The online game play may involve players who are also physically remote from each other. Remote connections may use networks involving several types of network links including, but not limited to, the Internet. Networked connections allowing physically remote players to play a game using a game server or system may be part of an implementation of a virtual or online gaming environment. Networked connections may also be part of a wireless gaming environment within a casino.

Live, electronic, or online-implementations of the methods described herein may be configured for administration as either "play-for-pay" embodiments or "play-for-fun" embodiments. In play-for-pay embodiments, wagers having real-world monetary value are received and payouts having real-world monetary value may be distributed. Play-for-pay embodiments include "house-banked" embodiments and "player-banked" embodiments. In house-banked embodiments, payouts are paid by, and losses are retained by, the game administrator (e.g., a casino or other gaming establishment). In player-banked embodiments (e.g., "player-pooled progressive" configurations, "dividend refund" configurations), wagers are "raked" by the game administrator (i.e., a portion of the wagers are retained by the game administrator) and then pooled into a pot from which payouts are paid, which pot is eventually distributed to at least one player; thus, the game administrator retains only the raked amounts. Aside from play-for-pay embodiments, play-for-fun embodiments (e.g., "free play-for-fun" configurations, "social play-for-fun" configurations) involve receiving wagers having no real-world monetary value and distributing payouts having no real-world monetary value.

The actions described in this disclosure as the acts of a player, including betting, card selection (if any), card evaluation, card discards (if any), play elections, or any other actions, may also be characterized as acts of the system, such as receiving an indication of a wager or a bet, distributing cards or representations of cards, receiving indications of play elections, etc. These steps may be carried out over a network where the indicated actions are received as input to a device, or the actions are in response to inputs from a device. The input-receiving device is typically physically remote from the game server or game host and is connected over a long-distance network, but may also be implemented over a wired or wireless LAN in one building, or even in one room, for example. In one embodiment, game play generated at the server or host location may be displayed on the same device as the receiving device. In some embodiments, game play may be conveyed to remote players in devices separate from the devices receiving input from a player, such as public screens or publicly broadcast data about a game coupled with individual or private input devices. The reception of an input at a device may be accomplished through any technology adapted for such a purpose including, but not limited to, keypads, keyboards, touchpads, touch screens, buttons, mice, optical location devices, eye movement/location detectors, sound input devices, iPad's, iPhones, Androids, other cell phones, electronic tablets, personal computers, etc. When discussing a device, it is understood the device may comprise multiple components and be complex, including hardware components combined with firmware and/or software, and may itself be a subcomponent of a larger system.

Yet other embodiments may comprise apparatuses and systems for administering wagering games according to embodiments of the disclosure. For example, a gaming station may comprise a single player electronic gaming machine, a multiple player electronic gaming machine, a gaming table with electronic betting interfaces, a multiple player gaming platform that displays electronic representations of cards but utilizes physical chips, and other known and future platforms that enable wagering game play, and play-for-fun versions of wagering game play.

BRIEF DESCRIPTION OF THE SEVERAL VIEWS OF THE DRAWINGS

While the disclosure concludes with claims particularly pointing out and distinctly claiming embodiments within the scope of the disclosure, various features and advantages of embodiments encompassed by the disclosure may be more readily ascertained from the following description when read in conjunction with the accompanying drawings, in which:

DETAILED DESCRIPTION

Figure 1:
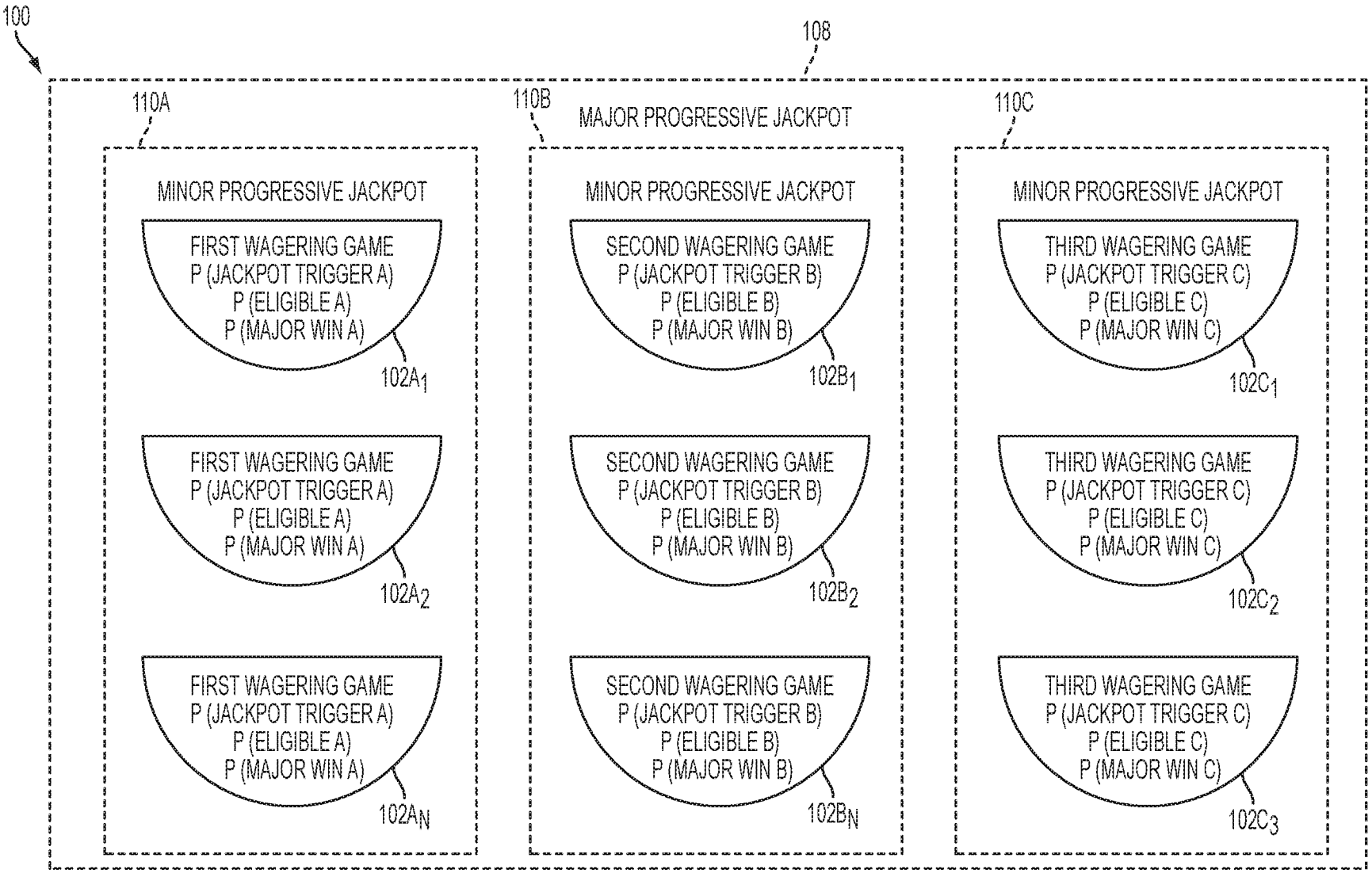
FIG. 1 is a simplified block diagram of a progressive gaming system.

The illustrations presented herein are not meant to be actual views of any particular act in a method of administering a wagering game, apparatus for use in administering a wagering game, or component thereof, but are merely idealized representations employed to describe illustrative embodiments. Thus, the drawings are not necessarily to scale. Additionally, elements common between figures may retain the same or similar numerical designation. Elements with the same number, but including a different alphabet character as a suffix should be considered as multiple instantiations of substantially similar elements and may be referred generically without an alphabet character suffix. For example, elements 100*a*, 100*b*, and 100*c*, may be a device that is instantiated three times and generically referred to herein as element 100.

The terms "gaming," "gambling," or the like, refer to activities, games, sessions, rounds, hands, rolls, operations, and other events related to wagering games such as web-based games, casino games, card games, dice games, and other games the outcome of which is at least partially based on one or more random events ("chance" or "chances"), and on which wagers may be placed by a player. In addition, the words "wager," "bet," "bid," or the like, refer to any type of wager, bet, or gaming venture that is placed on random events, whether of monetary or non-monetary value. Points, credits, and other items of value may be purchased, earned, or otherwise issued prior to beginning the wagering game. In some embodiments, purchased points, credits, or other items of value may have an exchange rate that is not one-to-one to the currency used by the user. For example, a wager may include money, points, credits, symbols, or other items that may have some value related to a wagering game. Wagers may be placed in wagering games that involve the risk of real-world monetary value for the potential of payouts with real-world monetary value (e.g., the "play-for-pay," "player-pooled progressive," and "dividend refund" configurations, which are described in more detail below) or in wagering games that involve no real-world monetary risks for the player (e.g., the "play-for-fun" and "social play-for-fun" configurations, which are also described in more detail below).

As used herein, the term "wager" includes any form of wagering value, including money, casino chips, other physical means for payment, and online or remote electronic authorization of a wager in any acceptable form to the casino or online or virtual game host. Also included are physical representations of money (e.g., casino chips) at a local gaming table 900, or 1000 (see FIGS. 9, and 10), or electronic authorizations of a transfer of money or digital representations of money (e.g., digital representations of bills or coins, digital representations of chips, numerical quantities of money, numerical quantities of points, or numerical quantities of credits) at a local or remote electronic gaming device 800, 900, 1000, 1120, or 1240 (see FIGS. 8 through 12). In the "play-for-fun" and "social play-for-fun" configurations, a "wager" may not have a cash value (i.e., a real-world monetary value), or may have a value that permits redemption of the non-monetary payouts for prizes, privileges and game play advantages, such as an award of extra non-monetary chips, an award of a time compression or an award of a special game piece or special game element.

For the purposes of this description, it will be understood that when an action related to accepting wagers, making payouts, dealing cards, selecting cards, or other actions associated with a player or a dealer are described, the description includes a player or a dealer taking the action, the results of the action on a live or virtual table or display, and, if applicable, the reception or detection of such an action in an electronic form where player and dealer choices, selections, or other actions may be received at an electronic interface. This further includes the results of a virtual dealer and virtual players, where the actions described are actually generated by a computer (typically associated with an online game). By way of a further example, if dealing of a card is described herein, the description includes (but is not limited to) the following: the dealing of a card by a dealer from a deck, shuffler, a shoe, or other card source and the reception or placement of the card at a table location associated with a player or reception directly by a player; the generation and transmission of an electronic indication or representation of a card from a game play source or server to an electronic receiver, where the receiver may be at a table (using virtual cards) including players and/or virtual players and/or a dealer or virtual dealer, at a public display in a casino, at a remote location (e.g., using online or Internet game play), or at other locations. Also included is the representation of a card on a display or displays, and, if applicable to the action described, an electronic reception of an indication that the card has been received, selected, or otherwise interacted with at a location associated with a player, or, associated with a virtual player. In addition, dealing of a card may refer to revealing a representation of a card on a scratch-off card (also referred to as "scratchers").

It is to be understood that in some embodiments, when a dealer hand is dealt or the dealer otherwise takes action, it is not necessary to display a dealer or a dealer representation on a player display. For example, if the player hand must be compared to a dealer hand to determine if the hand wins, it is only necessary to display a dealer hand, not an actual dealer or representation of a dealer.

In addition, it is noted that the embodiments may be described in terms of a process that is depicted as a flowchart, a flow diagram, a structure diagram, or a block diagram. Although a flowchart may describe operational acts as a sequential process, many of these acts can be performed in another sequence, in parallel, or substantially concurrently. In addition, the order of the acts may be re-arranged. A process may correspond to a method, a function, a procedure, a subroutine, a subprogram, etc. Furthermore, the methods disclosed herein may be implemented in hardware, software, or both. If implemented in software, the functions may be stored or transmitted as one or more instructions (e.g., software code) on a computer-readable medium. Computer-readable media includes both computer storage media and communication media including any medium that facilitates transfer of a computer program from one place to another.

It should be understood that any reference to an element herein using a designation such as "first," "second," and so forth does not limit the quantity or order of those elements, unless such limitation is explicitly stated. Rather, these designations may be used herein as a convenient method of distinguishing between two or more elements or instances of an element. Thus, a reference to first and second elements does not mean that only two elements may be employed there or that the first element must precede the second element in some manner. Also, unless stated otherwise a set of elements may comprise one or more elements.

The term "dealer," as used herein, refers to any person or thing that administers a wagering game in any capacity, and should not be understood to be limited to persons who deal cards to players. For example, the "dealer" may comprise a processor programmed with a set of game rules and a display for displaying a dealer hand of cards, rather than a display of a dealer or representation of a dealer. Likewise, the term "dealer interface" should be understood to include an interface configured for use by any person who administers a wagering game in any capacity. The term "dealer," in some embodiments, may also refer to a computerized dealer which administers a wagering game autonomously, partially autonomously, or by initiation of an on-site or remote human operator. A dealer may also be referred to as an assistant or an attendant.

Embodiments of the present disclosure may include a progressive jackpot system that enables players of different wagering games to have substantially the same odds of winning a major progressive jackpot, regardless of the odds of achieving a winning outcome in a particular wagering game. Wagering games having winning outcomes that are based on dissimilar probabilities may be linked to the same major jackpot, and an assigned probability of a particular type of wagering game being selected to qualify for major progressive jackpot play is used to normalize the jackpot winning probability across all wagering games linked to the major progressive jackpot.

FIG. 1 is a simplified block diagram of a progressive jackpot system 100 according to an embodiment of the present disclosure. The progressive jackpot system 100 may include a plurality of gaming stations 102$A_1$, 102$A_2$, . . . 102$A_N$, 102$B_1$, 102$B_2$, . . . 102$B_N$, 102$C_1$, 102$C_2$, . . . 102$C_N$ (sometimes referred to generally herein collectively as "gaming stations 102," and individually as "gaming station 102"). The common use of subscript "N" among the different groups does not mean that each group must have the same number of gaming stations 102. The subscript "N" is merely used as a convenient way to indicate that each group of gaming stations 102 may have any number of gaming stations 102.

The gaming stations 102 may include, but are not limited to, gaming tables, gaming machines, electronic gaming devices, gaming cabinets, personal computers, laptop computers, tablet computers, smart phones, and other gaming apparatuses that are configured to administer various wagering games. Each gaming station may be used to administer a wagering game played by a single player, or by multiple players. When the gaming station is a conventional gaming table, multiple players typically participate simultaneously in playing a casino game such as Three Card Poker™, Ultimate Texas Hold 'Em®, or other community card game. Other gaming stations may be electronic gaming machines configured for single player play. Yet other gaming stations may be personal computers or mobile devices in the case of on online game play, or multiple player systems such as an all-electronic multiple player platform or a hybrid platform such as one that utilizes physical cards and credit wagering, virtual cards and physical chips, or combinations thereof.

The gaming stations 102 may be configured to interact with a player or multiple players of a wagering game during game play. The wagering games may include card games, dice games, and other games of chance in which a wager may be placed. Examples of wagering games may include, but are not limited to, poker variations, blackjack, bingo, keno, craps, slots, pachinko, baccarat, roulette, betting on sporting events, and other wagering games. The different wagering games may have different rules, win probabilities, betting amounts, pay tables, etc.

Each of the gaming stations 102 may be linked to a major progressive jackpot 108. The major progressive jackpot 108 includes a common progressive jackpot for linked gaming stations 102 that are configured to administer different wagering games. For example, a first group of gaming stations 102$A_1$, 102$A_2$, . . . 102$A_N$ may be configured to administer a first wagering game, a second group of gaming stations 102$B_1$, 102$B_2$, . . . 102$B_N$ may be configured to administer a second wagering game, and a third group of gaming stations 102$C_1$, 102$C_2$, . . . 102$C_N$ may be configured to administer a third wagering game.

Other jackpots may also be offered. For example, a minor progressive jackpot 110 may be offered. In some embodiments, the gaming stations 102 administering the same wagering games may be linked to participate in a minor progressive jackpot 110, as well as the major progressive jackpot 108. For example, the first group of gaming stations 102$A_1$, 102$A_2$, . . . 102$A_N$ may linked to a first minor progressive jackpot 110A, in addition to the major progressive jackpot 108. The second group of gaming stations 102$B_1$, 102$B_2$, . . . 102$B_N$ may be linked to a second minor progressive jackpot 110B and to the major progressive jackpot 108. The third group of gaming stations 102$C_1$, 102$C_2$, . . . 102$C_N$ may be linked to a third minor progressive jackpot 110C and to the major progressive jackpot 108. Other progressive jackpots may also be offered (e.g., individual gaming station progressive jackpots), as well as additional major and minor progressive jackpots of varying sizes. For example, multiple major progressive jackpots may be offered that encompass different numbers of gaming stations 102 even if the different major progressive jackpots overlap for some of the gaming stations 102. As a result of generally being linked to a higher number of gaming stations 102, the amount to be won in the major progressive jackpot 108 may often be higher than the amounts to be won in the minor progressive jackpots 110 and the other progressive jackpots. Jackpots may have a jackpot cycle and the jackpot amount can grow to a theoretical maximum amount at the time the jackpot hits. By adding more gaming stations 102 to a jackpot system, the jackpot reaches its theoretical maximum sooner and more jackpot cycles are completed in a unit of time, attracting more players to play the jackpot game. In some embodiments, there may be situations in which the amount to be won in the major progressive jackpot 108 may be less than the amounts to be won in the minor progressive jackpots 110 and other progressive jackpots.

A player may win the major progressive jackpot 108 responsive to the occurrence of a jackpot trigger. In other words, the jackpot trigger is a predetermined occurrence that may result in a player winning the major progressive jackpot 108. By way of non-limiting example, the jackpot trigger may be a predetermined winning game outcome (e.g., a particular card combination, reel position, etc.). The winning game outcome may depend on the type of wagering game and its associated rules. The jackpot trigger may be selected as the winning game outcome that is associated with the top prize for the wagering game; however, that does not necessarily have to be the case. The winning game outcome associated with the top prize for the wagering game is normally used because it typically has the lowest probability of the various winning game outcomes. One example of a hand that is commonly used as a jackpot trigger that pays the top prize for a game based on 5-card poker hand combinations is a royal flush. In some embodiments, there may be multiple jackpot triggers that have different results. For example, a first jackpot trigger may result in winning the entirety of the major progressive jackpot 108, and a second jackpot trigger may result in winning the entirety of the minor progressive jackpot 110. As another example, a first jackpot trigger may win 100% of a major jackpot and a second jackpot trigger may win 25% of the same major jackpot. Some jackpot triggers may result in winning a portion of either the major progressive jackpot 108 and/or the minor progressive jackpot 110.

The probability of achieving a particular winning game outcome may depend on the type of wagering game and its associated rules. Because the gaming stations 102 may not all administer the same wagering game, the different wagering games may have winning game outcomes that are based on dissimilar winning game outcome probabilities. As a result, the probabilities of the jackpot triggers may be different from gaming station 102A to gaming station 102B. For example, referring to FIG. 1, the first wagering game administered by each of the first group of gaming stations 102$A_1$, 102$A_2$, . . . 102$A_N$ may have a first jackpot trigger probability P(JackpotTriggerA). The second group of gaming stations 102$B_1$, 102$B_2$, . . . 102$B_N$ may have a second jackpot trigger probability P(JackpotTriggerB). The third group of gaming stations 102$C_1$, 102$C_2$, . . . 102$C_N$ may have a third jackpot trigger probability P(JackpotTriggerC). The jackpot trigger probabilities refer to the winning game outcome(s) associated with the particular wagering game that is used to trigger a first (minor) jackpot winning event. Because the wagering games are different, the jackpot trigger probabilities may also be different. For example:

$$P(\text{JackpotTrigger}A)=1/X;$$

$$P(\text{JackpotTrigger}B)=1/Y;\text{ and}$$

$$P(\text{JackpotTrigger}C)=1/Z,$$

where "X" is the average number of rounds of the first wagering game for its jackpot trigger to occur, "Y" is the average number of rounds of the second wagering game for its jackpot trigger to occur, and "Z" is the average number of rounds of the third wagering game for its jackpot trigger to occur.

The probability of winning the major progressive jackpot 108 is referred to as the major jackpot winning probability P(MajorWin). The progressive jackpot system 100 may be configured to normalize the major jackpot winning probabilities for the different types of wagering games that are linked to the same major progressive jackpot 108. For example, the progressive jackpot system 100 may be configured such that the players of the progressive jackpot system 100 may have substantially the same odds of winning the major progressive jackpot prize, regardless of the jackpot trigger probability P(JackpotTrigger) of the particular wagering game. Thus, P(MajorWinA), P(MajorWinB), and P(MajorWinC), may be substantially equal even though P(JackpotTriggerA), P(JackpotTriggerB), and P(JackpotTriggerC) may be dissimilar. In other words, after normalization:

$$P(\text{MajorWin}A)\approx P(\text{MajorWin}B)\approx P(\text{MajorWin}C).$$

In some embodiments, the progressive jackpot system 100 may assign each gaming station 102 to have an eligibility probability P(Eligible) for participating in the major progressive jackpot 108. This eligibility probability P(Eligible) is a probability for each gaming station 102 to be eligible for winning the major progressive jackpot 108 during game play. In other words, the gaming station 102 may be eligible for winning the major progressive jackpot 108 during some (but not all) opportunities during game play according to its eligibility probability P(Eligible). As a result, a player may only win the major progressive jackpot 108 when the jackpot trigger occurs and when the gaming station 102 is eligible. Thus, even if the jackpot trigger is achieved when the gaming station 102 is not eligible, the major progressive jackpot 108 may not be won. In some embodiments, the same jackpot trigger wins the first minor jackpot and the major jackpot, so when a game round is not eligible for major jackpot play and the player holds a jackpot triggering hand, the player wins the minor jackpot instead of the major jackpot. In other embodiments, the jackpot triggers to win the entire jackpots are different. In some embodiments, there are multiple jackpot triggers, with one premium hand that wins 100% of the jackpot, and other hands that win either a percentage of the jackpot, an odds payout or a fixed amount.

The probability for each player winning the major progressive jackpot 108 may be normalized by adjusting an eligibility probability P(Eligible) for each gaming station 102. The probabilities for winning the major progressive jackpot 108 may be:

$$P(\text{MajorWin}A)=P(\text{JackpotTrigger}A)*P(\text{Eligible}A);$$

$$P(\text{MajorWin}B)=P(\text{JackpotTrigger}B)*P(\text{Eligible}B);$$

and $$P(\text{MajorWin}C)=P(\text{JackpotTrigger}C)*P(\text{Eligible}C).$$

For the major jackpot winning probabilities P(MajorWin) to be substantially equal among the different gaming stations 102, the eligibility probabilities P(Eligible) among the different gaming stations 102 may be dissimilar. For example, P(EligibleA), P(EligibleB), and P(EligibleC) may be dissimilar.

The eligibility probability P(Eligible) of a particular gaming station 102 may be proportional to the inverse of the jackpot trigger probability P(JackpotTrigger) for that particular gaming station 102. For example, the eligibility probability P(Eligible) may be determined by dividing the major jackpot winning probability P(MajorWin) by the jackpot trigger probability P(Eligible) of the wagering game.

As discussed above, the different wagering games may have different game rules and game outcome probabilities. For example, the following example is provided to illustrate an embodiment of the progressive jackpot system 100 having three different card games linked to the same common major progressive jackpot 108. In this example, the first group of gaming stations 102$A_1$, 102$A_2$, . . . 102$A_N$ may administer the "Three Card Poker™" game, owned and distributed by SHFL entertainment, Inc., assignee of the present disclosure as the first wagering game, the second group of gaming stations 102$B_1$, 102$B_2$, . . . 102$B_N$ may administer the "Let it Ride®" game, owned and distributed by SHFL entertainment, Inc., assignee of the present disclosure as the second wagering game, and the third group of gaming stations 102$C_1$, 102$C_2$, . . . 102$C_N$ may administer the game "Three Card Poker—Six Card Bonus™" owned and distributed by SHFL entertainment, Inc. as the third wagering game.

The Three Card Poker™ game is a poker game in which three cards are dealt to both the player and the dealer. The player hand and the dealer hand are compared to determine whether the player has a winning hand. The top ranking hand is a 3-card Royal Flush (e.g., Ace, King, Queen of the same suit). The probability that a player wins a Royal Flush during Three Card Poker is approximately 1/5,525 (i.e., 0.018%). The 3-card Royal Flush may be used as the jackpot trigger for the Three Card Poker™ wagering game first or minor jackpot.

The Let it Ride® game is a five card poker game based on a dealt five card hand. Three cards are dealt to each player, and those cards are combined with two community cards to form a best five-card hand. The top ranking hand is a 5-card Royal Flush (e.g., Ace, King, Queen, Jack and Ten of the same suit). The probability that a player wins a Royal Flush during the Let it Ride® game is approximately 1/649,000 (i.e., 0.000154%). The 5-card Royal Flush may be used as the jackpot trigger for the Let it Ride® wagering game.

The Three Card Poker-Six Card Bonus™ game is a three card poker game in which the player may make an optional progressive side bet to play the six card bonus option. For this six card bonus option, the player may be paid when the best five out of the player's three cards and the dealer's three cards is a premium 5-card poker hand. The probability that a player receives a five-card Royal Flush (the top ranking hand) from these six cards is approximately 1/108,290 (i.e., 0.000923%). The 5-card Royal Flush may be used as the jackpot trigger for the Three Card Poker—Six Card Bonus™ wagering game.

Thus, using the jackpot triggers discussed above, the jackpot trigger probabilities P(JackpotTrigger) are summarized in the following table:

| Wagering Game | P(JackpotTrigger) |
|---|---|
| Three Card Poker | P(JackpotTriggerA) = 1/5,525 = 0.018% |
| Let it Ride | P(JackpotTriggerB) = 1/649,000 = 0.000154% |
| Three Card Poker - Six Card Bonus | P(JackpotTriggerC) = 1/108,290 = 0.000923% |

As a result, the jackpot trigger for Three Card Poker may occur more frequently than the jackpot trigger for Let it Ride. The jackpot trigger for Let it Ride, however, may occur less frequently than the jackpot trigger for Three Card Poker—Six Card Bonus. The progressive jackpot system 100 may be configured to normalize the winning probabilities such that the overall probability for winning the major progressive jackpot 108 is substantially equal for each player regardless of which wagering game they are playing.

As discussed above, the progressive jackpot system 100 may assign each gaming station 102 to have an eligibility probability P(Eligible) for participating in the major progressive jackpot 108. In some embodiments, the eligibility probability P(Eligible) for each gaming station 102 may be determined by dividing the average number of rounds typically required to achieve the top prize in the wagering game, by the sum of the average number of rounds required to achieve a top prize in each linked wagering game type. For example, if "X," "Y," and "Z" are the average number of rounds for the jackpot triggers to occur for the respective first, second, and third wagering games, the eligibility probabilities for each round of the wagering games may be:

$$P(\text{Eligible}A)=X/(X+Y+Z);$$

$$P(\text{Eligible}B)=Y/(X+Y+Z); \text{ and}$$

$$P(\text{Eligible}C)=Z/(X+Y+Z).$$

In this example, X=5,525, Y=649,000, and Z=108,290. The eligibility probabilities P(Eligible) are summarized by the following table:

| Wagering Game | P(Eligible) |
|---|---|
| Three Card Poker | P(EligibleA) = 5,525/762,815 = 0.72% |
| Let it Ride | P(EligibleB) = 649,000/762,815 = 85.08% |
| Three Card Poker - Six Card Bonus | P(EligibleC) = 108,290/762,815 = 14.20% |

Thus, by adjusting the eligibility probabilities P(Eligible), the major jackpot winning probability P(MajorWin) may be normalized for each wagering game. As a result, the major jackpot winning probability P(MajorWin) may be the same for each player of the progressive jackpot system 100 regardless of which wagering game is being played. The major jackpot winning probabilities P(MajorWin) are shown by the following table:

| Wagering Game | P(MajorWin) = P(JackpotTrigger)*P(Eligible) |
|---|---|
| Three Card Poker | P(MajorWinA) = (5,525/762,815)*(1/5,525) = 0.000131% |
| Let it Ride | P(MajorWinB) = (649,000/762,815)*(1/649,000) = 0.000131% |
| Three Card Poker - Six Card Bonus | P(MajorWinC) = (108,290/762,815)*(1/108,290) = 0.000131% |

Another example is provided to illustrate that the progressive jackpot system 100 may have a major jackpot winning probability P(MajorWin) that is set at any probability that is desirable, but lower than the probability of any individual jackpot trigger. For example, the previous example set the major jackpot winning probability P(MajorWin) to be dependent on the odds of winning the wagering games themselves (i.e., the denominator was the sum of the number of rounds to achieve the jackpot trigger for all underlying wagering games). The probabilities, however, may be normalized for any probability desired. For example, a casino might desire for the major jackpot to accrue to a relatively large value. In order to offer such a large jackpot, a player winning the major progressive jackpot 108 may need to occur infrequently. As a result, the probability of occurrence of a player winning the major progressive jackpot 108 may be selected to be a set number that is relatively low (e.g., $1/5{,}000{,}000$).

| Wagering Game | P(MajorWin) |
|---|---|
| Three Card Poker | P(MajorWinA) = (1/5,000,000) = 0.00002% |
| Let it Ride | P(MajorWinB) = (1/5,000,000) = 0.00002% |
| Three Card Poker - Six Card Bonus | P(MajorWinC) = (1/5,000,000) = 0.00002% |

In this example, the individual jackpot triggers (and their associated probabilities) for each wagering game may remain the same as the previous example:

| Wagering Game | P(JackpotTrigger) |
|---|---|
| Three Card Poker | P(JackpotTriggerA) = 1/5,525 = 0.018% |
| Let it Ride | P(JackpotTriggerB) = 1/649,000 = 0.000154% |
| Three Card Poker - Six Card Bonus | P(JackpotTriggerC) = 1/108,290 = 0.000923% |

The eligibility probability P(Eligible) for each wagering game may be different from the previous example. For example, the eligibility probability P(Eligible) may be determined by dividing the desired major jackpot winning probability P(MajorWin) by the jackpot trigger probability P(JackpotTrigger) for the associated wagering game.

| Wagering Game | P(Eligible) = P(MajorWin)/P(JackpotTrigger) |
|---|---|
| Three Card Poker | P(EligibleA) = 5,525/5,000,000 = 0.1105% |
| Let it Ride | P(EligibleB) = 649,000/5,000,000 = 12.98% |
| Three Card Poker - 6 Card Bonus | P(EligibleC) = 108,290/5,000,000 = 2.17% |

As a result, players playing the Three Card Poker™, Let it Ride®, or Three Card Poker—6 Card Bonus™ games may have a 1 in 5,000,000 (i.e., 0.00002%) chance of winning the major progressive jackpot 108 regardless of the wagering game they respectively play. A player playing the Three Card Poker game may only have a 0.1105% chance (i.e., 0.00002%*5525) of being eligible to play for the major progressive jackpot 108. Similarly, players playing the Let it Ride game may have a 12.98% chance (i.e., 0.00002%*649,000) of being eligible to play for the major progressive jackpot 108. Players playing the Three Card Poker—Six Card Bonus game may have a 2.17% chance (i.e., 0.00002%*108,290) of being eligible to play for the major progressive jackpot 108. Although each wagering game has a different probability of being eligible for participation in the major progressive jackpot 108, each player has the same individual probability of winning the major jackpot (e.g., 1 in 5,000,000) regardless of the underlying wagering game.

Another example is provided to illustrate that the progressive jackpot system 100 may link wagering games of a different type to a common major progressive jackpot 108 (whereas the first example provided involved different wagering games of the same type (e.g., card games)). In this next example, the first group of gaming stations 102$A_1$, 102$A_2$, . . . 102$A_N$ may administer roulette as the first wagering game, the second group of gaming stations 102$B_1$, 102$B_2$, . . . 102$B_N$ may administer blackjack as the second wagering game, and the third group of gaming stations 102$C_1$, 102$C_2$, . . . 102$C_N$ may administer a five-card draw poker game as the third wagering game.

For a roulette game, the jackpot trigger may be set at the roulette ball landing on 00 (or some other number). The probability of this game outcome may be $1/37$ (i.e., 2.7%). For a blackjack game, the jackpot trigger may be set at the player being dealt three unsuited sevens. The probability of this game outcome may be about $1/2{,}502$ (i.e., 0.04%). For a five-card draw poker game, the jackpot trigger may be set at the player being dealt a five card straight flush. The probability of this game outcome may be about $1/72{,}193$ (i.e., 0.0014%). These jackpot trigger probabilities are summarized in the following table:

| Wagering Game | P(JackpotTrigger) |
|---|---|
| Roulette | P(JackpotTriggerA) = 1/37 = 2.7% |
| Blackjack | P(JackpotTriggerB) = 1/2,502 = 0.04% |
| Five Card Draw Poker | P(JackpotTriggerC) = 1/72,193 = 0.0014% |

It may be desired to set the probability of winning the major progressive jackpot 108 at $1/1{,}000{,}000$ (i.e., 0.0001%), as shown below:

| Wagering Game | P(MajorWin) |
|---|---|
| Roulette | P(MajorWinA) = (1/1,000,000) = 0.0001% |
| Blackjack | P(MajorWinB) = (1/1,000,000) = 0.0001% |
| Five Card Draw Poker | P(MajorWinC) = (1/1,000,000) = 0.0001% |

The corresponding probability of a current round of the roulette game being eligible for the major progressive jackpot 108 may be the product of $1/1{,}000{,}000$ and 37/1 (i.e., 0.0037%). The corresponding probability of a current round of the blackjack game being eligible for the major progressive jackpot 108 may be the product of $1/1{,}000{,}000$ and 2,502/1 (i.e., 0.25%). The corresponding probability of a current round of the poker game being eligible for the major progressive jackpot 108 may be the product of $1/1{,}000{,}000$ and 72,193/1 (i.e., 7.2%).

| Wagering Game | P(Eligible) = P(MajorWin)/P(JackpotTrigger) |
|---|---|
| Roulette | P(EligibleA) = 37/1,000,000 = 0.0037% |
| Blackjack | P(EligibleB) = 2,502/1,000,000 = 0.25% |
| Five Card Draw Poker | P(EligibleC) = 72,193/1,000,000 = 7.2% |

As illustrated by these examples, if the jackpot trigger probability P(JackpotTrigger) is relatively higher, a lower eligibility probability P(Eligible) may be required for the current round to be eligible for participating in the major progressive jackpot 108. Also, if the jackpot trigger probability P(JackpotTrigger) is relatively low, a higher eligibility probability P(Eligible) may be required for the current round of game play to be eligible for participating in the major progressive jackpot 108.

In some embodiments, a single gaming station 102 may be configured to host a plurality of different wagering games. In such embodiments, a player at the first gaming station $\mathbf{102}A_1$ may be allowed to play for the major progressive jackpot 108 while playing the first wagering game (e.g., Three Card Poker), then switch to the second wagering game (e.g., Roulette) on the same first gaming station $\mathbf{102}A_1$ while still playing for the same major progressive jackpot 108. In such embodiments, the eligibility probability P(EligibleA) for the first gaming station $\mathbf{102}A_1$ may adjust to the appropriate probability that maintains the same major jackpot winning probability P(MajorWinA) as before with the first wagering game. As a result, the first gaming station $\mathbf{102}A_1$ may maintain the same major jackpot winning probability P(MajorWinA) as the other gaming stations 102 linked to the major progressive jackpot 108. The player may compete for the same major progressive jackpot 108 without the amount of major progressive jackpot 108 being diminished or increased.

Although the examples herein may appear to discuss gaming stations 102 being linked together in a single casino, it is also contemplated that gaming stations 102 from different casinos, and gaming stations 102 located in different gaming jurisdictions, may be linked together to participate in the major progressive jackpot 108. In addition, the different gaming stations 102 may administer the various wagering games in multiple different formats. For example, the gaming stations 102 may administer wagering games offered on different platforms, such as live table game play in a traditional casino environment or "felt games" offered on hybrid table systems that utilize standard cards and electronic betting interfaces (e.g., SHFL entertainment's i-Table® system), tables that utilize physical chips and virtual cards (e.g., the DigiDeal® table system), electronic multiple player gaming systems (e.g., SHFL entertainment's Table Master® Fusion™ and Vegas Star® platforms), on-line gaming, on-line play-for-fun gaming, wagering on wireless devices within a casino, wagering games played on mobile devices (e.g., smart phones, tablet computers, etc.), and on-line games that wager on hands of physical cards being dealt by dealers in remote studios, with live video feed of game play transmitted over the Internet. By linking many gaming stations 102 and/or wagering games offered in multiple formats, increased participation on the major progressive jackpot 108 may occur. As a result, the time needed to complete a jackpot cycle may be reduced while still awarding large jackpots.

Figure 2:
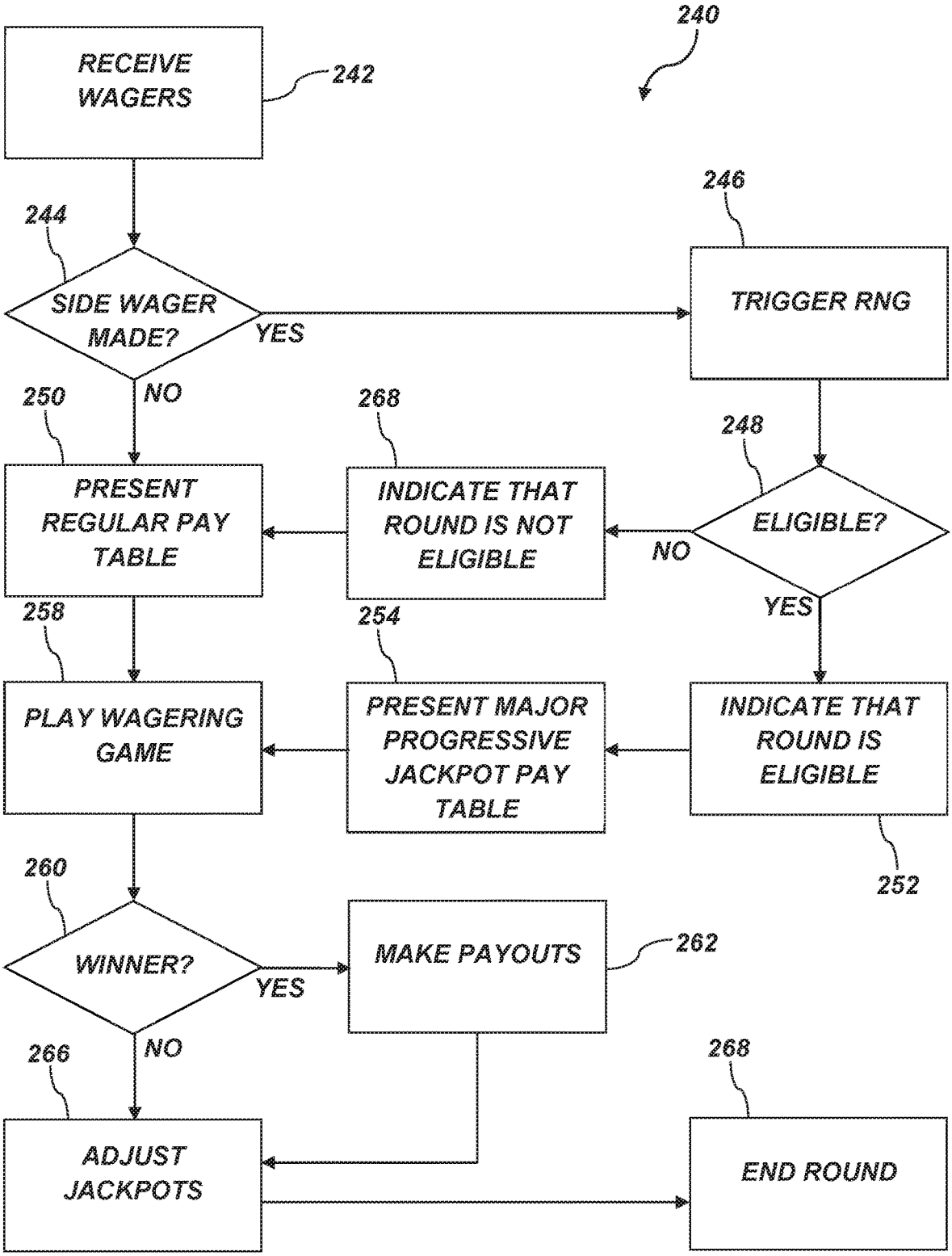
FIG. 2 is a simplified flowchart of a method of operating a progressive wagering game.

FIG. 2 is a simplified flowchart 240 illustrating a method of operating a progressive jackpot wagering game. The method may include receiving first wagers from one or more players to participate in a current round of game play at operation 242 and a first minor jackpot. The wagers may be received by the dealer and/or a player interface. For example, on a traditional gaming table, a bet sensor may sense the presence of a wager, and in response to sensing, send a signal to a processor indicating a progressive wager is in action.

In some embodiments, the method may also include requiring the player to place a separate major jackpot side wager for participation in the major progressive jackpot 108. In other embodiments, only one progressive wager is made, with a portion of the bet funding a first minor jackpot and a second portion of the wager funding a major progressive jackpot. This wager is typically raked, and the casino may also use part of the wagers to fund smaller fixed and odds payouts that are part of the bonus game. The one or more jackpot wagers may be mandatory or may be optional. Thus, in some embodiments, the players may elect whether or not to even participate in the major progressive jackpot 108. If a player elects not to participate in the major progressive jackpot 108, and only one wager is required to participate in one or both jackpots, in response to a player election not to participate in the major progressive jackpot 108, a processor may allocate all of the portion of the wager that normally goes to the major progressive jackpot account to the first minor progressive jackpot account.

At operation 244, it is determined if any players placed the major jackpot side wager for a chance at winning the major progressive jackpot 108. For players that did not place a major jackpot side wager, a regular pay table excluding the major progressive jackpot 108 may be presented at operation 250. The regular pay table may identify prizes, such as some or all of the minor progressive jackpot 110, other progressive jackpots, or fixed prizes, or odds payouts (not shown) to be won. By way of non-limiting example, for a Texas Hold'em poker game, the regular pay table may be:

| Event: | Prize: |
|---|---|
| Seven Card Straight Flush (minor progressive jackpot trigger) | 100% of the minor progressive jackpot 110 |
| Five Aces (other progressive jackpot trigger) | 100% of the other progressive jackpot |
| Royal Flush | $500 |
| Straight Flush | $100 |
| Four of a Kind | $75 |
| Full House | $4 |

The regular pay table may be presented to the players by the gaming station 102 (e.g., a player interface, community player display, the dealer, a jackpot meters, or combinations thereof). The jackpot triggers for the wagering game may result in winning the minor progressive jackpot 110 or other jackpots, but not the major progressive jackpot 108.

Returning to operation 244, for players that did place the major jackpot side wager or a single wager that qualified the player for playing for multiple jackpot prizes including the major progressive jackpot 108, the eligibility for the major progressive jackpot 108 may be determined. Eligibility may be determined using a randomly generated number that is applied to the eligibility probability P(Eligible) for the particular wagering game.

At operation 246, a random number may be requested by triggering the random number generator (RNG) to produce a random number. In some embodiments, the RNG may be triggered by the dealer selecting a button on the dealer interface of a game controller or an automatic card shuffler for requesting the random number. In some embodiments, the random number may be requested automatically by the gaming station 102 responsive to receipt of the at least one major jackpot side wager. The random number returned may be a randomly selected integer that is within a predetermined range (e.g., a range between 1 and 1,000,000). For the following example, a range of 1,000,000 is described for limiting the random number generation; however, it should be clear that any range may be used so long as the probabilities remain the desired percentage.

At operation 248, the eligibility of the gaming station 102 may be determined according to the eligibility probability P(Eligibility) for the particular wagering game. As an example, if the eligibility probability P(Eligibility) is 2,502/1,000,000, the gaming station 102 may be eligible for the major progressive jackpot 108 if the random number is within a range of 1 to 2,502. The range may be any range of 2,502 numbers (whether consecutive or non-consecutive) within the larger range of 1 to 1,000,000 so long as the eligibility probability P(Eligible) remains the desired percentage.

If it is determined that the gaming station 102 is not eligible for the major progressive jackpot 108 during the current round of game play, an indication may be given to the player that the current round is not eligible for the major progressive jackpot 108 at operation 268. If, however, it is determined that the gaming station 102 is eligible for the major progressive jackpot 108 during the current round of game play, that indication may be given to the player that the current round is eligible for the major progressive jackpot 108 during the current round of game play, as indicated by operation 252. The indication of being eligible or not eligible for the major progressive jackpot 108 may be given to the player via a player interface, the dealer, a jackpot meters, chip sensors, or combinations thereof. When the gaming station 102 is a gaming table, all players at the gaming table may be eligible for bonus play when the gaming table is randomly selected. This group play eligibility in such a live table game embodiment may create great excitement and anticipation in the game. In such an embodiment, the eligibility may be displayed on a community display, such as the same display used to display the game rules and/or pay table. In some embodiments, the appropriate indication may be provided to the player after bets have been received, but before actual play of the wagering game. In some instances, the knowledge that the current round of game play is eligible for the major progressive jackpot 108 may add excitement to the current round, which may also encourage participation in the major progressive jackpot side bet in the future. In addition, the player's strategy for the current round may also change. For example, a player may sacrifice the chances of winning a lower prize in the underlying wagering game in favor of trying to win the major progressive jackpot 108. Although indicating the eligibility of the current round may affect game play, the current game's eligibility may be indicated to the players regardless of the effects on game play. In other embodiments, the eligibility of a gaming station 102 for major progressive jackpot play may be determined before wagers are made, encouraging more play when players are eligible for major progressive jackpot play for those players who enjoy long-shot bets, and more play on the first minor progressive jackpot when the gaming station 102 is not eligible for players who enjoy competing to win smaller jackpots.

The eligibility of the gaming station 102 may determine which pay table is used for the current round. At operation 250 (not eligible for the major progressive jackpot 108), the regular pay table may be presented and used for the current round. At operation 254 (eligible for the major progressive jackpot 108), a separate major progressive jackpot pay table may be presented and used for the current round. By way of non-limiting example, for a Texas Hold'em wagering game, the major progressive jackpot pay table may be:

| Event: | Prize: |
|---|---|
| Seven Card Straight Flush (major progressive jackpot trigger) | 100% of the major progressive jackpot 108 |
| Five Aces (minor progressive jackpot trigger) | 100% of the minor progressive jackpot 110 |
| Royal Flush | $500 |
| Straight Flush | $100 |
| Four of a Kind | $75 |
| Full House | $4 |

The second pay table may incorporate a top prize from the first pay table, as shown above, or play for the major jackpot may alternatively exclude players from qualifying for first minor jackpot wins. A seven card straight flush may be a major progressive jackpot trigger, which may award 100% of the major progressive jackpot 108. A hand with five aces may be a minor progressive jackpot trigger, which may award 100% of the minor progressive jackpot 110. In some embodiments, certain jackpot triggers may award a value less than 100% of one or more of the jackpot amounts.

At operation 258, the round of game play may be played. In some embodiments the game play may begin at the initiation of the dealer (e.g., by pressing a start button on a dealer interface). In other embodiments, the round of game play may begin automatically without dealer intervention, such as automatically after eligibility for the major progressive jackpot 108 is determined. At operation 260, the winners are determined based on the game outcomes and the pay table being used for that round.

If a winning event is determined, payouts are issued at operation 262. The winning event may be jackpot trigger, in which case the jackpot is paid to the player. The winning event may simply be a non-jackpot winning event, in which the appropriate amount is paid to the player. If no winning event is determined, no payouts are made.

At operation 266, the jackpot amounts may be adjusted. For example, if the major progressive jackpot 108 was won, the major progressive jackpot 108 may be reset to its starting amount. A typical starting amount is a "seed" amount and this amount is typically funded by the jackpot side bet and held in reserve. When a player wins the full jackpot, emptying the entire jackpot account, this amount held in reserve is transferred to the jackpot account to encourage play. A portion of the bets (from operations 244, 242, or both) may be allocated to the reserve account until the seed amount is reestablished in the reserve account. For pay tables that pay less than the full jackpot amount, the jackpot may be decremented by the amount paid to the player. In this event, no seed money is transferred to the jackpot account. If the major progressive jackpot 108 was not won, the major progressive jackpot 108 may be incremented to increase the amount to be won in a subsequent round.

In some embodiments, the jackpot amount may not be incremented until the end of a round of game play, providing the players a fixed amount of money to play for. In other embodiments, the jackpot amount may be incremented before each round of game play, giving the players the opportunity to win back contributions made at operation 242 and operation 244 to the major progressive jackpot 108. At operation 268, the round of game play may end. In some embodiments, the dealer may press an end button to end the round. In other embodiments, the round may automatically end.

The flowchart 240 of FIG. 2 described the progressive jackpot system 100 selecting between two pay tables. The present disclosure, however, is not so limited. It is contemplated that any number of pay tables may be used. In some embodiments, the random number received from a RNG may be used to select from a plurality of different pay tables.

Figure 3:
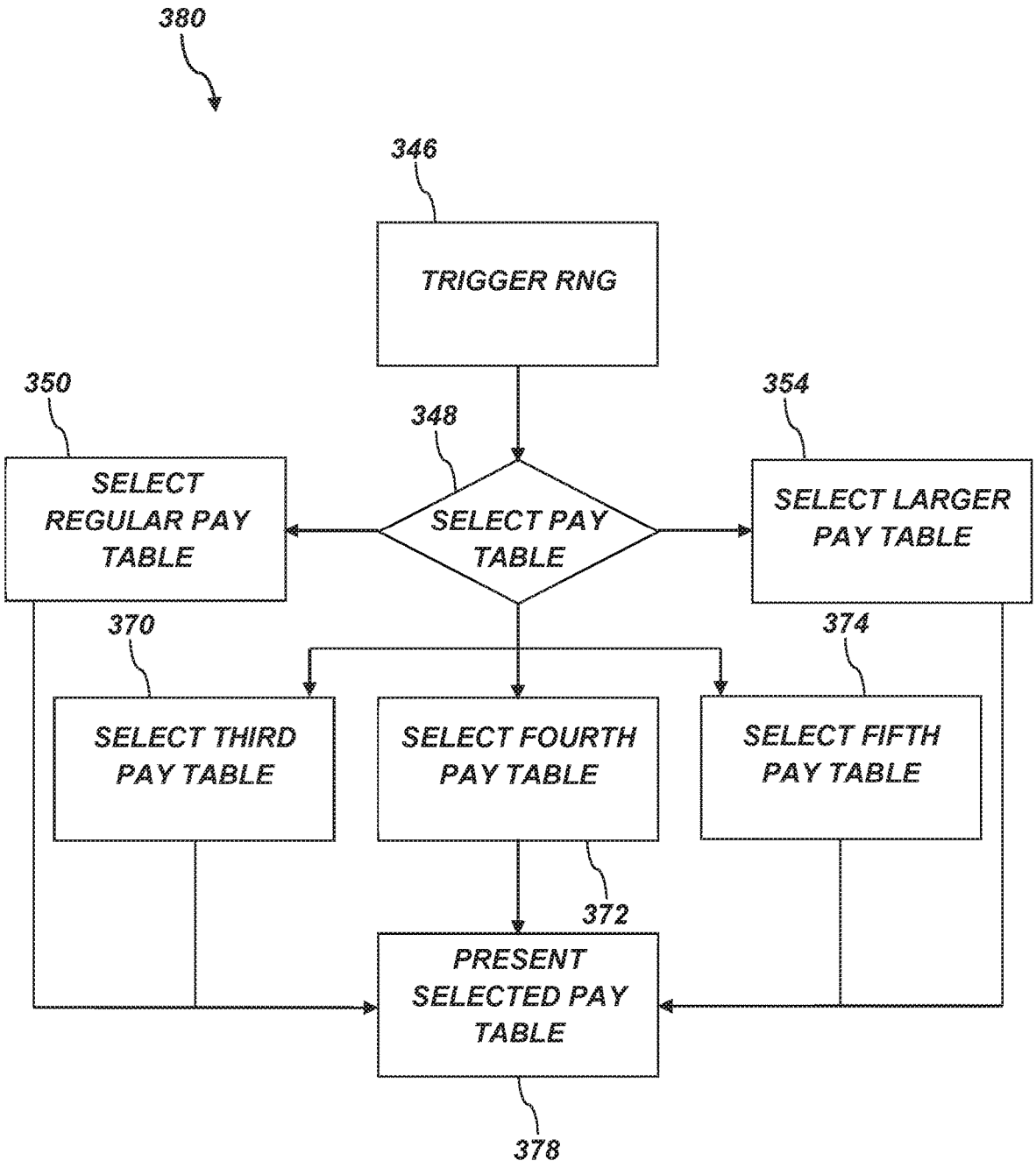
FIG. 3 is a simplified flowchart of a non-limiting example of a method of selecting between several different pay tables.

FIG. 3 is a simplified flowchart 380 illustrating a method of selecting between a plurality of different pay tables. The method may include initiating the RNG at operation 346. The initiation may be performed manually or automatically. The RNG may generate a random number, which may be used to select a pay table from a plurality of pay tables at operation 348. The plurality of pay tables may include a regular pay table and a major progressive jackpot pay table, such as those described with respect to FIG. 2. The plurality of pay tables may also include a third pay table, a fourth pay table, and a fifth pay table. The third pay table may be:

| Event: | Prize: |
|---|---|
| Seven Card Straight Flush | 100% of the major progressive jackpot 108 |
| Five Aces | 100% of the minor progressive jackpot |
| Royal Flush | $500 + 2% of the major progressive jackpot |

-continued

| Event: | Prize: |
|---|---|
| Straight Flush | $100 |
| Four of a Kind | $75 |
| Full House | $4 |

The fourth pay table may be:

| Event: | Prize: |
|---|---|
| Seven Card Straight Flush | 100% of the minor progressive jackpot 110 |
| Five Aces | 100% of another progressive jackpot |
| Royal Flush | $500 + 2% of the major progressive jackpot |
| Straight Flush | $100 |
| Four of a Kind | $75 |
| Full House | $4 |

The fifth pay table may be:

| Event: | Prize: |
|---|---|
| Seven Card Straight Flush | 100% of the minor progressive jackpot 110 + 5% of the major progressive jackpot 108 |
| Five Aces | 100% of another progressive jackpot + 3% of the major progressive jackpot 108 |
| Royal Flush | $500 + 2% of the major progressive jackpot 108 |
| Straight Flush | $100 + 1% of the major progressive jackpot |
| Four of a Kind | $75 |
| Full House | $4 |

Although the plurality of pay tables include jackpot triggers that are directed to a poker wagering game, at other gaming stations 102, the pay tables may include jackpot triggers directed to other wagering games for the particular gaming stations.

Each of the plurality of pay tables may be assigned a range of values, wherein the pay table assigned a range that encompasses the random number produced by the RNG may be selected. For example, the method may include selecting the regular pay table at operation 350, selecting the major progressive jackpot pay table at operation 354, selecting the third pay table at operation 370, selecting the fourth pay table at operation 372, or selecting the fifth pay table at operation 374 responsive to the RNG producing a random number falling within a range of values assigned to a particular pay table. The ranges assigned to each of the plurality of pay tables may be configured such that the eligibility probability P(Eligible) that the current round qualifies for the major progressive jackpot 108 is inversely proportional to the jackpot trigger probability P(Jackpot-Trigger), such that the major jackpot winning probability P(MajorWin) is approximately the same across the gaming stations 102 regardless of the wagering game being played. At operation 378 the selected pay table may be presented to the players and used for the current round.

Figure 4:
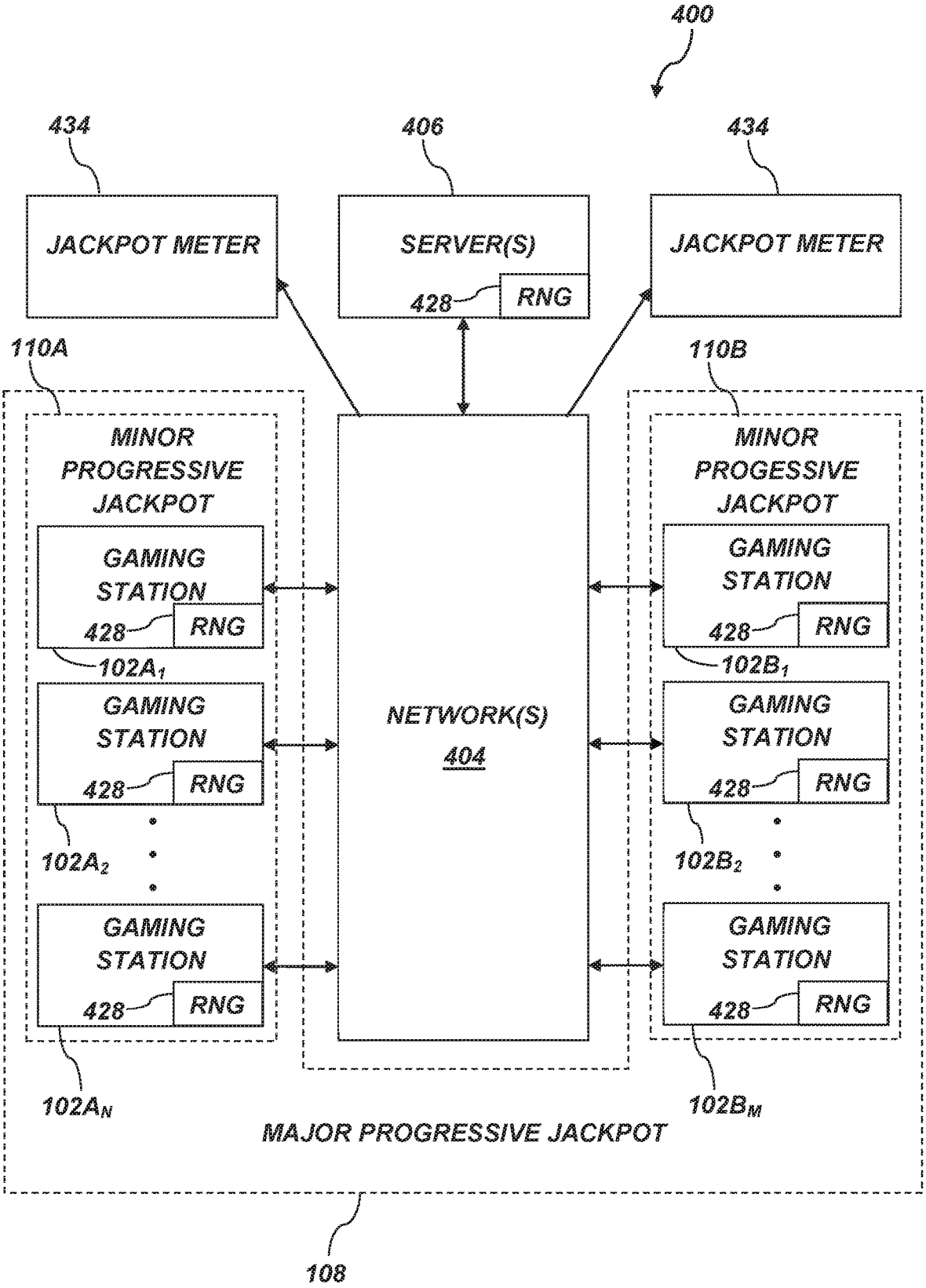
FIG. 4 is a simplified block diagram of a progressive gaming system.

FIG. 4 is a simplified block diagram of a progressive jackpot system 400 according to an embodiment of the present disclosure. The progressive jackpot system 400 of FIG. 4 shows various components that may be used to implement the progressive jackpot system 100 of FIG. 1. The progressive jackpot system 400 may include a plurality of gaming stations 102 linked to a major progressive jackpot 108. The gaming stations 102 may be linked to the major progressive jackpot 108 through one or more servers 406. The one or more servers 406 may communicate with the gaming stations 102 over one or more networks 404. As discussed above, a portion of the gaming stations 102 may be linked to a minor progressive jackpot 110A, 110B or other progressive jackpots (not shown).

The one or more networks 404 (sometimes referred to herein as "networks 404") may be configured to transmit communications between each of the gaming stations 102 and the servers 406, such as by using an internet protocol (IP). The networks 404 may include a wide area network (WAN), a local area network (LAN), a personal area network (PAN), and combinations thereof. In some embodiments, the servers 406 may be part of a cloud network. The networks 404 may be configured to communicate with the plurality of gaming stations 102 and the servers 406 wirelessly, through a cable, and combinations thereof. Some non-limiting examples of suitable wireless communications may include "Wi-Fi," BLUETOOTH®, and mobile wireless networks. Some non-limiting examples of suitable cables may include fiber-optic cables, coaxial cables, traditional telephone cables, and Ethernet cables. More detail regarding the networks 404 is discussed with reference to the network 1130 of FIG. 11. The networks 404 may also comprise cell phone networks in some embodiments. Non-limiting examples of suitable cell phone network protocols include 3G and 4G networks, for example.

The servers 406 may include one or more computing devices (as explained in more detail with respect to FIG. 5) configured to operate the major progressive jackpot 108. The servers 406 may also be configured to operate the minor progressive jackpots 110 and/or the other progressive jackpots. By way of non-limiting example, the servers 406 may comprise a single dedicated computing device located in a central location, and configured to operate each of the major progressive jackpot 108, the minor progressive jackpots 110, and any other progressive jackpots. In other embodiments, the servers 406 may include a computing device configured to operate the major progressive jackpot 108, and one or more additional computing devices each configured to operate a minor progressive jackpot 110. In still other embodiments, the servers 406 may include a plurality of computing devices configured to collectively operate the major progressive jackpot 108, the minor progressive jackpots 110, and the other progressive jackpots, but that no one server may be dedicated to operate a particular one or more of progressive jackpots.

It should also be noted that each of the gaming stations 102 themselves may include a computing device, and may collectively or individually be a part or all of the servers 406. To illustrate the idea of the gaming stations 102 operating as part of the servers 406, a dedicated computing device may operate the major progressive jackpot 108 and the minor progressive jackpots 110, and the gaming stations 102 may each operate another progressive jackpot. The servers 406 may optionally provide online gaming services, and may include a user interaction server 1102, an asset server 1104, a game server 1106, an account server 1110, and combinations thereof, the specific functions of each of which are discussed in more detail with respect to FIG. 11. Some of the servers 406 may optionally be part of an online gaming system (FIG. 11), which, in some embodiments, may be implemented with a computer system 1240, as discussed with respect to FIG. 12.

The gaming stations 102, the server 406 (or both) may include a random number generator (RNG) 428. The RNG may reside in the server 406, a gaming station controller, or in other equipment at the game station, such as within a shuffler. The RNG 428 may be configured to generate a random number (e.g., a true random number a pseudo-random number, etc.). The term "random number," as used herein, may be a true random number or a pseudo-random number. The RNG 428 may be entropy-based, computationally based, and combinations thereof. Random numbers may be used during game play in determining game outcomes according to the game rules, as well as in determining eligibility of the gaming stations 102 for the major progressive jackpot 108.

The progressive jackpot system 100 may also include a plurality of jackpot meters 434 configured to indicate an amount of money to be won in the major progressive jackpot 108. The jackpot meters 434 may also be configured to indicate an amount of money to be won in a minor progressive jackpot 110 and other minor progressive jackpots, if any. The jackpot meters 434 may be positioned to present the amount to be won in the major progressive jackpot 108 to players and people passing the gaming stations 102 to increase the excitement and appeal of the wagering games hosted at the gaming stations 102.

As discussed above, the gaming stations 102 may be gaming tables that administer different types of card games. The first group of gaming stations 102$A_1$, 102$A_2$, . . . 102$A_N$ may be part of a first same-game network, and the second group of gaming stations 102$B_1$, 102$B_2$, . . . 102$B_N$ may be part of a second same-game network. In some embodiments, each gaming station 102 of a same-game network may administer the same wagering game. In some embodiments, the gaming stations 102$A_1$, 102$A_2$, . . . 102$A_N$ of the first same-game network may include the same electronics as the gaming stations 102$B_1$, 102$B_2$, . . . 102$B_N$ of the second same-game network, but that the wagering game hosted thereon may be different. Although many examples herein describe gaming tables and card games, it is contemplated that other types of gaming stations 102 and wagering games may be part of the progressive jackpot system 100 in addition to (or instead of) gaming tables and card games.

In operation, each gaming station 102 in the same-game network may have the same eligibility probability P(Eligible) as the other gaming stations 102 in the same-game network. But gaming stations 102 in other same-game networks may have a different eligibility probability P(Eligible) than others, when the game is different. In addition, in some embodiments, only a gaming station 102 that has requested participation (e.g., by requesting a random number) may qualify for participation in the major progressive jackpot 108. For example, in some embodiments a player may be required to place a major progressive jackpot side wager before eligibility may be determined. If no major progressive jackpot side wager is placed, regular game play may commence without any participation in the major progressive jackpot 108. In that case, the dealer would not request a determination of eligibility by requesting a random number, and if the system automatically generated a random number in response to a major jackpot side bet being placed, no random number would be requested. In some embodiments, the major progressive jackpot side wager may fund the major progressive jackpot 108. In some embodiments, the major progressive jackpot side wager may also fund the minor progressive jackpots 110 and other progressive jackpots. Thus, in some embodiments players may place one side wager to participate in both the major and minor progressive jackpots 108, 110. For example, 80% of the side wager after the rake may be applied to the minor progressive jackpot 110, and 20% of the side wager after the rake may be applied to the major progressive jackpot 108. Of course, different divisions are contemplated. For example, the side wager after the rake may be split other ways such as 90/10, 30/70, 50/50, 70/30, 80/20, and 90/10. In some embodiments, the input device may include two or more bet sensors per player interface and separate side wagers may be placed against the major progressive jackpot 108 and the minor progressive jackpot 110. These funds may be separately raked and the accounts may be separately maintained.

The dealer may request a random number selection, or the system may automatically sense a "next round" condition and request a random number automatically when a bet on the occurrence of winning a major jackpot prize is sensed. The random number selected may be used to determine if the gaming station 102 requesting the random number is eligible (i.e., qualifies) for the major progressive jackpot 108. The player may be notified (e.g., through a player display or a community player display) that the gaming station 102 is or is not eligible for major bonus play after bets have been placed and betting is closed. Providing a visual indication of an opportunity to win the major progressive jackpot 108 after betting closes may add excitement and anticipation to the game play, as well as encourage participation in the major progressive jackpot side wager in the future.

Figure 5:
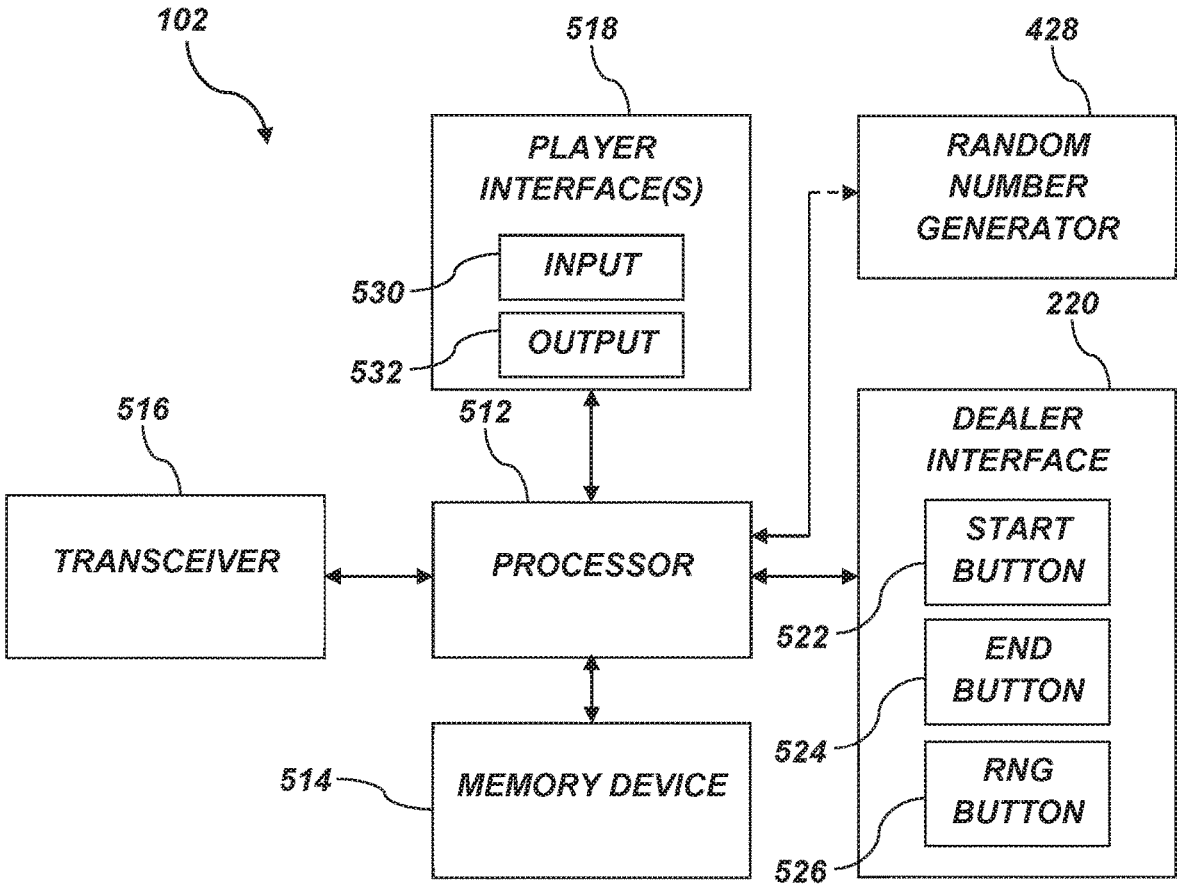
FIG. 5 is a simplified block diagram of a gaming station of the progressive gaming system of FIG. 1.

FIG. 5 is a simplified block diagram of a gaming station 102 of the progressive jackpot system 100 of FIG. 4. The gaming station 102 may include a processor 512 operably coupled to a memory device 514, a transceiver 516, one or more player interfaces 518, and a dealer interface 220. The transceiver 516 may be configured to enable the gaming station 102 to communicate with the servers 406 (FIG. 4) through the networks 404 (FIG. 4).

The player interfaces 518 may be configured to enable one or more players to participate in a wagering game, such as wagering games hosted on the gaming station 102 that include player-processor interaction. The player interfaces 518 may include an input device 530 and an output device 532. The input device 530 may include a wager receptacle (e.g., a credit card reader, a coin or chip receptacle, an electronic object sensing sensor such as the "coin spot" sensor described in U.S. Pat. No. 7,367,884, the content which is hereby incorporated by reference in its entirety, etc.). The input device 530 may also include other input devices that may depend on the type of wagering game being administered, such as, for example, a touch screen, a camera, a microphone, a slot machine lever, a button array, a keyboard, a mouse, a track pad, and other similar devices. The output device 532 may include a liquid crystal display (LCD), a light-emitting diode (LED) array, a cathode ray tube (CRT), an audio speaker, a plurality of reels, and other output devices appropriate for the wagering game being administered by the gaming station 102. In some embodiments, the jackpot meters 434 (FIG. 4) may be implemented as part of the one or more player interfaces 518.

In some embodiments, the one or more player interfaces 518 may not be operably coupled to the processor 512, such as in gaming stations 102 configured to host wagering games not including player-processor interaction. By way of non-limiting example, the one or more player interfaces 518 may be a table with a surface for playing a wagering game (e.g., a card game, a dice game, etc.), a roulette wheel, other wagering game devices, and combinations thereof. In still other embodiments, the gaming station 102 may include one or more player interfaces 518 operably coupled to the processor 512 and the dealer interface 520. By way of non-limiting example, the gaming station 102 may include a wager receptacle such as a coin slot or a wager indicator such as a "coin spot" sensor operably coupled to the processor 512, and optionally to the dealer interface 520.

The dealer interface 520 may include a start button 522, an end button 524, and a random number generator (RNG) button 526. A dealer may press the start button 522 to start game play at the gaming station 102. The dealer may press the end button 524 to end game play at the gaming station 102. The dealer may press the RNG button 526 to cause the random number generator 428 to be triggered. The dealer interface 520 may also include game-specific devices such as, for example, an automatic card shuffler (not shown), other game-specific devices, and combinations thereof. In some embodiments, the dealer and the dealer interface 520 may be located at the same location as the player and the player interface 518. In some embodiments, the dealer interface 520 may be located remotely from the rest of the gaming station 102, and interface with the processor 512 by communicating with the transceiver 516 through the networks 404. It should also be understood that more than one gaming station 102 may be linked to the same dealer interface 520.

A dealer at the dealer interface 520 may receive wagers from the players desiring to participate in the wagering game. The dealer may also receive an optional side-wager from players desiring to participate in the major progressive jackpot 108 (FIG. 1), minor progressive jackpot 110, or both. In some embodiments, the dealer may receive the wagers from the players. In other embodiments, the one or more player interfaces 518 may receive the wagers at a wager receptacle. The RNG 428 may be triggered either automatically, or by the dealer pressing the RNG button 526, responsive to receipt of a side wager to participate in the major progressive jackpot 108.

The processor 512 may be configured to receive the random number from the RNG 428, and utilize the random number to determine if a current round of game play is eligible for the major progressive jackpot 108 (FIG. 1). The RNG 428 may be initiated to generate the random number responsive to the dealer pressing the RNG button 526 at the dealer interface 520, or automatically. In some embodiments, the RNG 428 may be integrated as part of the dealer interface 520. In other embodiments, the gaming station 102 may already include an RNG 428, such as, for example, in an automatic shuffler, an electronic wagering game, etc. In still other embodiments, the RNG 428 may be integrated at a location remote from the gaming station 102, such as, for example, at the servers 406.

The memory device 514 may be configured to store machine-readable commands, digital data, and combinations thereof. By way of non-limiting example, the memory device 514 may be a computer readable media, such as read only memory (ROM), a random access memory (RAM), a Flash memory, a hard disk drive, and combinations thereof. The memory device 514 may be operably coupled to the processor 512. In some embodiments, the memory device 514 may store the game rules and executable commands, which may incorporate the probabilities used therein (including P(JackpotTrigger), P(Eligible)). The memory device 514 may also store one or more pay tables identifying prizes corresponding to one or more possible progressive jackpot triggers that may occur during game play. The pay tables may identify the prizes to be awarded for the major progressive jackpot 108, the minor progressive jackpots 110, as well as other progressive jackpots. In addition, the pay tables may indicate fixed prizes, such as, for example, fixed payouts, and other prizes, for one or more other events.

The processor 512 may be configured to execute machine-readable commands stored in the memory device 514. The processor 512 may also be configured to process communications received by the transceiver 516, and cause the transceiver 516 to send communications over the one or more networks 404 (FIG. 4). By way of non-limiting example, the processor 512 may be a microcontroller, a field programmable gate array (FPGA), a programmable logic controller (PLC), an application-specific integrated circuit (ASIC), and combinations thereof. The processor 512 may be configured to cause the RNG 428, if any, to generate a random number.

Figure 6:
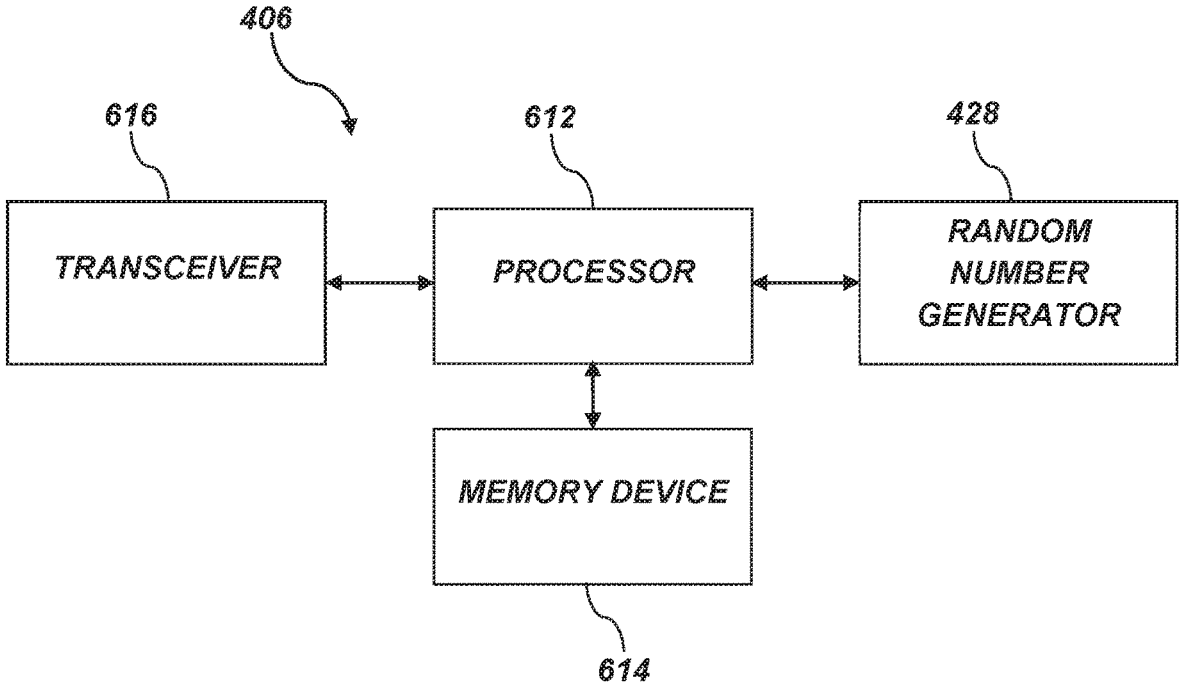
FIG. 6 is a simplified block diagram of one or more servers of the progressive gaming system of FIG. 1.

FIG. 6 is a simplified block diagram of the server 406 of FIG. 4. The server 406 may comprise computing devices including a processor 612 operably coupled to a transceiver 616 and a memory device 614. The server 406 may further include a RNG 428 configured to generate a random number for determining eligibility of a gaming station 102 for participation in the major progressive jackpot 108 during a current round of play. As discussed above, the random number generation may be performed by the gaming station 102, by equipment located at the gaming station 102 such as an automatic card shuffler (not shown) and/or the server 406.

The memory device 614 may be configured to store the value attributable to each of the major progressive jackpot 108 and the minor progressive jackpots 110, if any. The processor 612 may adjust (e.g., increment, decrement) the amounts stored in the memory device 614 of the major progressive jackpot 108, and the minor progressive jackpots 110 responsive to each wagering game played at each of the gaming stations 102. The server 406 may also cause the jackpot meters 434 (FIG. 4) to indicate the changed (e.g., increased or decreased) amounts of money in each of the major progressive jackpot 108, and the minor progressive jackpots 110. The memory device 614 may also be configured to store the eligibility probability P(Eligible) and/or the jackpot trigger probability P(JackpotTrigger) associated with each of the wagering games administered by each of the gaming stations 102.

In operation, an optional major jackpot side wager (or optional jackpot side wager when only one wager is required to play to win both jackpots) may be received from a player wishing to participate in the major progressive jackpot 108. If the optional major jackpot side wager is received, the servers 406 may utilize the RNG 428 to determine whether the current round of game play is eligible for the major progressive jackpot 108. By way of non-limiting example, the servers 406 may cause the current round of game play to be eligible for the major progressive jackpot 108 if the RNG 428 outputs a number that is either greater or smaller than a threshold C within an interval of A to B defining eligibility. The threshold C may be adjustable depending on the probability of the jackpot trigger. Also by way of non-limiting example, the threshold C may be stationary, and the limits A and B of the interval may be adjusted. Consequently, the probability of winning the major progressive jackpot 108 may be the same regardless of the wagering game hosted at a gaming station 102. In addition, the server 106 may cause an indication to be sent to the player to indicate whether or not the current round of game play is eligible for the major progressive jackpot 108. The indication may be sent to the player after bets have been made, but before the game play begins. After the game play is complete, the server 106 may adjust the progressive jackpot amounts according to the outcome of the wagering game.

It is noted that the gaming stations 102 (FIG. 5) may include similar functional components to the servers 406. In some embodiments, one or more of the gaming stations 102 may function as both the gaming stations 102 and as the servers 406. Also, as the gaming stations 102 and the servers 406 may be the same devices in some embodiments, instances of the present disclosure that describe the functions and components of the gaming stations 102 and the servers 406 separately should also be interpreted in the context of the gaming stations 102 acting as the servers 406.

Various platforms are contemplated that are suitable for implementation of embodiments of wagering games according to the present disclosure. For example, embodiments of wagering games may be implemented such that wagers may be received from one or more players, and game play may be administered with the one or more players according to the rules of the wagering games. For example, wagering games may be implemented on gaming tables, which may include physical gaming features, such as physical cards and physical chips, and may include a live dealer and a shuffler or shoe. More specifically, a live dealer may deal physical cards, evaluate hands, accept wagers, accept player elections, issue payouts, and perform other administrative functions of game play. Some embodiments may be implemented on electronic devices enabling electronic gaming features, such as providing electronic displays for display of virtual cards, virtual chips, game instructions, pay tables, etc. Some embodiments may include features that are a combination of physical and electronic features.

As an example, embodiments of wagering games may be implemented on a gaming station comprising an individual gaming device, such as an electronic gaming machine (hereinafter EGM), configured to accept wagers and having a display screen and input devices for enabling game play of the wagering games. Such an individual gaming device may be linked with other gaming devices that may be operated, for example, by other players. Some EGM's may be stationary, such as being located on a casino floor. Other individual electronic gaming devices may be portable devices that may be carried to different locations by the player. Portable devices may include both display of the ongoing game play and input reception for game play by a player. Portable devices may, alternatively or additionally, be configured for receiving input from a player while the game play is displayed on a public monitor or other display device. Game play and game outcomes may also be displayed on a portable device. When the gaming station is an individual gaming device, eligibility of the gaming station permits only one player to be eligible to participate in a game to win a major jackpot prize.

As previously noted, any of the present methods and games may be played as a live casino table card game, as a hybrid casino table card game (with virtual cards or virtual chips), on a multi-player electronic platform (as disclosed in U.S. patent application Ser. No. 10/764,827, filed Jan. 26, 2004, published as U.S. Patent Application Publication No. 2005/0164759 on Jul. 28, 2005, now abandoned; U.S. patent application Ser. No. 10/764,994, filed Jan. 26, 2004, now U.S. Pat. No. 7,661,676, issued Feb. 16, 2010; and U.S. patent application Ser. No. 10/764,995, filed Jan. 26, 2004, now U.S. Pat. No. 8,272,958, issued Sep. 25, 2012; the disclosure of each of which applications and patents is incorporated herein in its entirety by this reference), on a personal computer for practice, on a hand-held game for practice, or on a legally-authorized site on the Internet.

For example, in one embodiment, the players may be remotely located from a live dealer, and a live dealer and a game table may be displayed to players on their monitors via a video feed. The players' video feeds may be transmitted to the dealer and may also be shared among the players at the table. In a sample embodiment, a central station may include a plurality of betting-type game devices and an electronic camera for each game device. A plurality of player stations, remotely located with respect to the central station, may each include a monitor, for displaying a selected game device at the central station, and input means, for selecting a game device and for placing a bet by a player at the player's station relating to an action involving an element of chance to occur at the selected game device. Further details on gambling systems and methods for remotely-located players are disclosed in U.S. Pat. No. 6,755,741 B1, issued Jun. 29, 2004, titled "Gambling Game System and Method for Remotely-Located Players," the disclosure of which is incorporated herein in its entirety by this reference, and in connection with FIGS. 11 and 12.

In some embodiments, the wagering games described herein may be played against the game administrator, i.e., "the house" (i.e., be "house-banked"), which may involve the game administrator (e.g., a casino or other gaming establishment) receiving (via a dealer who may be employed by the administrator) wagers having real-world monetary value, comparing a player hand against a dealer hand, distributing payouts having real-world monetary value to winning players, and retaining lost wagers. Such "house-banked" embodiments may be implemented in the form of a live table game, in a virtual table game, in an electronic game, or in an on-line game configuration.

In other embodiments, the wagering games, or at least one wager associated with the wagering game, may qualify players to play against one another (i.e., be "player-banked"), with payouts on wagers being paid from a pot and losses on wagers being collected into the pot and eventually distributed to one or more players. Such player-banked embodiments may include a player-pooled progressive embodiment, in which a pot is eventually distributed when a predetermined progressive-winning hand combination or composition is dealt. Player-banked embodiments may also include a dividend refund embodiment, in which the pot is eventually distributed in the form of a refund distributed, e.g., pro-rata, to the players who contributed to the pot.

Figure 7A:
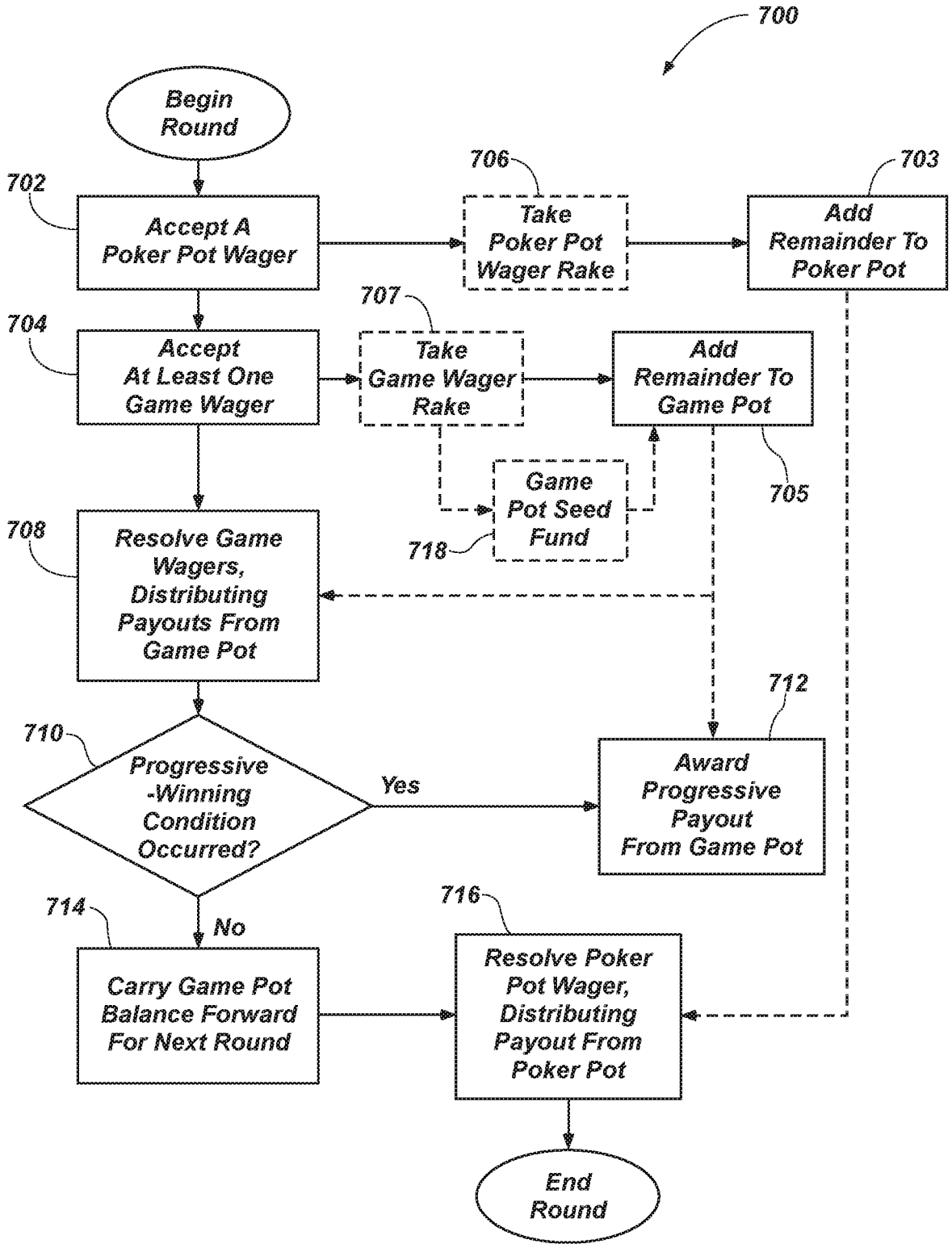
FIG. 7A is a flowchart diagram of a method of administering a wagering game, which may be at least partially player banked, according to a player-pooled progressive embodiment of the present disclosure.

Referring to FIG. 7A, a flow chart diagram of an optional method 700 administering a wagering game, which may be at least partially player-banked, is shown. This method may be most easily implemented in a computer-operated format, such as an online game, but may be implemented as a "felt" table game with equipment necessary to divide the wagers between the various accounts and to track account balances, such as the major and minor jackpot amounts. When implemented as an online game, this method may be used where house-banked games are not permitted, but where player vs. player poker is allowed. The method 700 includes accepting a first mandatory wager, referred to herein as a "poker pot wager," as indicated at operation 702. The poker wager is resolved by comparing player hands participating in the game and awarding the poker pot to the player with a winning or best hand at the end of a round of play. The dealer accepts at least a second wager that accumulates in at least a second pot, as indicated at operation 704. The second wager may comprise, for example, a base game wager (e.g., antes, blinds, play bets, raises, and other bets made on the underlying wagering game) or a side wager. The second wager may be accepted, for example, at the wager receptacle of the input device 530 or by a dealer, as described previously in connection with FIG. 5.

Optionally, a third pot wager may be accepted and added to at least a third pot. The third pot may be separate from either or both of the poker pot and the game pot. For example, the poker pot, the game pot, and the third pot may include chips located in separate areas on a gaming table, when the wagering game is conducted live in a casino. As another example, the poker pot, the game pot, and the third pot may be displayed as separate amounts on one or more video displays 874, 904, 916, 918, 930, 1032, 1060, 1064, or 1258 (see FIGS. 8, 9, 10, and 12) (e.g., a monitor) controlled by one or more of processors 850, 914, 928, 1097, or 1242 (see FIGS. 8, 9, 10, and 12) and may be maintained in separate accounts when the wagering game is conducted online or in another electronic format. The third wager may qualify a player to be eligible to win an additional award, such as, for example, one or more progressive payouts, including a major jackpot (e.g., a progressive jackpot awarded to one or more qualifying players). The third pot may accumulate between rounds of play, and to periodically reduce the balance, a dividend (e.g., a share of the second pot awarded to each participating player) may be awarded to players from the third pot.

In some embodiments, the third wager may be a mandatory wager. In other embodiments, the third wager may be optional (e.g., the major progressive jackpot 108 side wager), and the wagering game may be administered with a player without receiving the third wager from the player and without qualifying the player to be eligible to win any award from the third pot. In some embodiments, the third wager may include multiple sub-wagers. For example, the third wager may comprise a wager that causes the player to be eligible in both a first minor progressive jackpot 110 and a major progressive jackpot 108, or more than one minor progressive jackpot 110 or more than one major progressive pot 108. The third wager may be accepted, for example, at the wager receptacle of the input device 530 or by a dealer, as described previously in connection with FIG. 5.

In some embodiments, the game pot may be a pooled or linked pot. For example, the game pot may include one or more game wagers accepted from multiple concurrent wagering games. As another example, the game pot may include pooled progressive wagers from those wagering games currently being played and/or may include accumulated game wagers from past wagering games. As specific, nonlimiting examples, the game pot may include all game wagers accepted from a group of tables or local wagering game administration devices at a casino, from multiple groups of remote devices connected to network gaming architecture, or both. In other embodiments, the game pot may not be pooled, and awards for the game wager may be limited to the amounts wagered at a respective table, local wagering game administration device, or group of remote devices.

The gaming establishment (e.g., the "house") may take a "rake," (e.g., a commission for the house) on at least one wager, such as the poker pot wager, as indicated at operation 706 (and a remainder is added to the poker pot, as indicated by operation 703), the at least one game wager, as indicated at operation 707, or both. In some embodiments, therefore, a rake may be taken on all wagers, or any wager. For example, the house may collect a portion of the poker pot wager at the time the poker pot wager is placed. Additionally or alternatively, the house may collect a portion of the game wagers at the time the game wagers are placed.

The rake may comprise, for example, a fixed percentage of the wagers. More specifically, the percentage of the wagers collected for the rake may be, for example, greater than a theoretical house advantage for the underlying game. As another example, the rake may be less than an average house advantage for play of the wagering game by all players, including average and sub-average players, which may be calculated using a historical house advantage for the wagering game (e.g., a house advantage for the wagering game over the last 5, 10, or 15 years for a given casino or other gaming establishment). As specific, nonlimiting examples, the percentage of the wagers (i.e., either the poker pot wager, the at least one game wager and all jackpot wagers) collected for the rake may be between 3% and 8%, between 4% and 7%, or between 5% and 6%. In other embodiments, the portion of the wagers collected for the rake may comprise a variable percentage of the wagers or may comprise a fixed quantity (e.g., a flat fee) irrespective of the total amount for the wagers, a fixed percentage with a cap, or a time-based fee for increments of time playing the wagering game. Thus, in lieu of, or in addition to, a rake taken on one or more wagers, the house may be compensated in a number of other ways, including, without limitation, a flat fee per round of play, a percentage of wagers made with or without a cap, rental of a player "seat," or otherwise as is known in the gaming art. All such compensation may be generally referred to as a "commission." The rake may include money used to fund fixed pay awards, odds payout awards and other awards that are not a percentage (up to 100%) of the amount on the meter, but are part of the bonus payout pay structure.

All profits for the house may be made from the rake (or rakes or other commission) in some player-banked embodiments. In such embodiments, wagered amounts in excess of the rake are distributed either in the form of, for example, a progressive payout (as in a "player-pooled progressive" embodiment (FIG. 7A)), a dividend refund (as in a "dividend refund" embodiment (FIG. 7B)), or some combination thereof. Thus, the profits for the house are limited. Such limiting of profits for the house and redistribution of wagers back to one or more players may increase the attractiveness of the wagering game to both inexperienced and highly skilled players. Because the amount earned by the house is known, highly skilled players may perceive that their skill will enable them to increase winnings, and inexperienced players may be enticed by the possibility of winning or otherwise earning a portion or all of one or more of the pots. In other embodiments, the house may make profits on the rake and on losses from one or more of the wagers including losses resulting from optimal and suboptimal play.

The rake may be maintained in a rake account, and profits for the house may be deducted from the rake account. When and if taken from the poker pot wagers, the poker wager pot rake (operation 706) may be taken by, for example, electronically transferring funds from the poker pot wagers to a poker pot rake account (e.g., as instructed by a game server 1106 (see FIG. 11) using casino account servers 1110 (see FIG. 11)) or physically removing or exchanging money or representations of money from the poker pot wagers or the poker pot itself on a live table. Likewise, when and if taken from the game wagers, the game wager rake (operation 707) may be taken by, e.g., electronically transferring funds from the game pot wagers to a game pot rake account (e.g., as instructed by the game server 606 (see FIG. 9) using casino account servers 610 (see FIG. 9)) or physically removing or exchanging money or representations of money from the game wagers or the game pot itself on a live table.

In some embodiments, the poker pot wager may be accepted (operation 702) at the beginning of a round of administration of the wagering game. One or more of the game wagers may be accepted (operation 704) at the beginning of the round as well depending on the underlying wagering game. In some embodiments, additional game wagers may be accepted (operation 704), possibly raked (operation 707), and added to the game pot (operation 705) in the intermediate segments of the round of play depending on the underlying wagering game.

The underlying wagering game may be played as described above, including resolving the game wagers received during the round of play, as indicated at operation 708. For example, the underlying wagering game may be played according to the rules of the underlying wagering game.

At the end of a round of play, the first wager may be resolved and the first "poker" pot may be awarded to at least one player, as indicated at operation 710. Each successive round of making wagers, playing the round, and resolving wagers may constitute a round of play, and the first pot may be awarded to at least one player at the end of each round of play. The player to whom the first pot is awarded may hold a winning hand or at least a tying hand for that round of play according to the rules of the underlying wagering game amongst other players at the table. If no progressive winning condition occurred, a game pot balance may be carried forward for the nect round, as indicated by operation 714.

In some wagering games involving playing cards, a predetermined winning hand combination may comprise, for example, a four-of-a-kind, a full house, a flush, a straight, a three-of-a-kind, two pair, or one pair. The hands qualifying as new winning hand combinations may be predetermined at the beginning of each round of play in some embodiments. In other embodiments, new winning hand combinations may be predetermined at the beginning of play and may remain fixed until it is determined that at least one player hand achieves a predetermined winning hand combination, at which time new winning hand combinations may be predetermined. In still other embodiments, the hand combinations qualifying as winning hand combinations may be predetermined at the outset of the wagering game and remain fixed for the duration of the wagering game. The hands qualifying as winning hand combinations may be predetermined at random from a list of possible winning hand combinations, from among a schedule with a fixed rotation of possible winning hand combinations, or using a fixed table of winning hand combinations.

In some wagering games involving playing cards, a premium winning hand composition may comprise, for example, a four-of-a-kind, a straight flush, or a royal flush. The hand compositions qualifying as premium winning hand compositions may remain fixed throughout the duration of the wagering game or may change during the wagering game. For example, after it has been determined that a player hand has achieved a premium winning hand composition, the hand compositions qualifying as premium winning hand compositions may be made more restrictive or less restrictive. As a specific, nonlimiting example, after identification of a player hand achieving a straight flush, the hand compositions qualifying as premium winning hand compositions may be restricted to royal flushes or may be expanded to include four-of-a-kinds. The hands qualifying as premium winning hand compositions may be predetermined at random from a list of possible premium winning hand compositions, following a schedule with a fixed rotation of possible premium winning hand compositions, or according to a fixed table of premium winning hand compositions.

In embodiments in which the game pot is a progressive pot, the amount awarded from the game pot for achieving a premium winning hand composition may be a progressive payout at least as great as a maximum progressive payout for achieving a predetermined winning hand composition. For example, the entire game pot may be awarded when a player or multiple players are dealt a premium winning hand composition, and only a portion of the game pot may be awarded when a player or multiple players are dealt a predetermined winning hand combination.

Awarding the game pot or a portion of the game pot may comprise crediting a player account with funds from the game pot or may comprise distributing physical money or physical representations of money from the game pot to the player.

Before, between, or after resolving the game wagers (operation 708), determining whether a progressive-winning condition occurred (operation 710), awarding a progressive payout (operation 712), or any combination thereof, the poker pot wager may be resolved, and the poker pot may be awarded to at least one player, as indicated at operation 716. Each successive round of receiving wagers, dealing cards, and resolving wagers may constitute a round of play, and the poker pot may be awarded to at least one player before the end of each round of play. The player to whom the poker pot is awarded may hold a highest ranking hand amongst other players at the table according to the rules of the underlying wagering game.

Awarding the poker pot or the portion of the poker pot may comprise crediting a player account of each winning player or may comprise distributing physical money or physical representations of money to each winning player.

In some embodiments, an entire amount of the poker pot may be awarded to at least one player before the end of each round of play. In such embodiments, the poker pot may be a non-progressive pot. Awarding the entire poker pot to at least one player at the end of each round of play may enable an online implementation of the wagering game to qualify as a legal form of online poker play under relevant statutes. For example, in games that require a mandatory pot bet that has no house advantage, and all other game wagers are raked and then allocated to a second pot, the game may qualify as "poker" to gaming authorities, especially for online versions of the games. Awarding the entire amount of a poker pot to at least one player at the end of each round of play redistributes lost poker wagers attributable to suboptimal play to other players, rather than to the house. Accordingly, such a wagering game may be particularly attractive to players who perceive themselves as being highly skilled in the wagering game and, therefore, more able to take advantage of suboptimal play by other players.

In some embodiments, a portion of the poker pot may be awarded to at least one player at the end of each round of play (operation 716). For example, the house may take a rake on the poker wager (operation 706), which may still enable the wagering game to qualify as a legal form of online gambling under relevant statutes. The rake taken may comprise, for example, between 1% and 8%, between 2% and 6%, or between 3% and 5% of the first wager. The rake amounts on each wager may be more than, less than, or equal to the rake taken on other wagers in some embodiments.

Figure 7B:
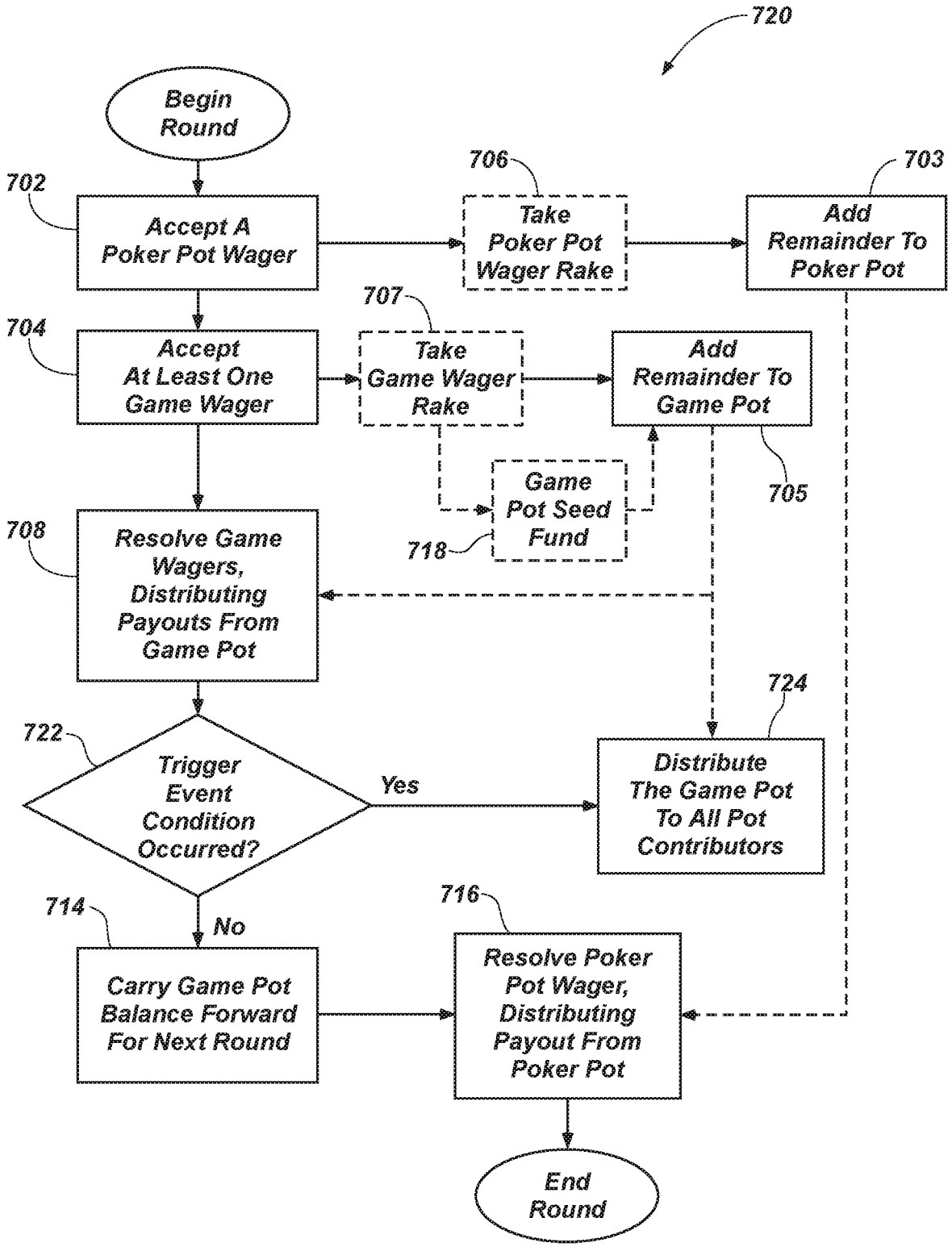
FIG. 7B is a flowchart diagram of a method of administering a wagering game, which may be at least partially player banked, according to a dividend refund embodiment of the present disclosure.

In still other embodiments, a portion of the poker pot may remain in the poker pot or may be redistributed to another pot (e.g., the game pot) to be awarded in a subsequent round of play as a progressive payout or as a dividend refund (see FIG. 7B). In such an example, the portion of the poker pot wager remaining in the poker pot or redistributed to another pot may comprise, for example, a fixed percentage of the poker pot wager, a variable percentage of the poker pot wager (e.g., an odds payout may be awarded and the remainder retained in the poker pot or redistributed to the other pot), or a fixed amount.

In embodiments where the second pot is a progressive pot, at least a portion of the second pot may be awarded to at least one player when a predetermined jackpot trigger occurs, such as, for example, a predetermined winning hand combination is dealt, as indicated at operation 712, or when a premium winning hand composition is dealt, as also indicated at operation 712. For example, a game may pay a progressive payout for a seven card straight flush in a Texas Hold'em wagering game. The second pot may not be awarded at the end of each round of play, but may grow during each successive round in which the predetermined jackpot trigger does not occur. Awarding the second pot or a portion of the second pot may comprise crediting a player account with funds from the second pot or may comprise distributing physical money or physical representations of money from the pot to the player.

In some embodiments involving a no-house-advantage poker pot awarded at the end of each round and a progressive game pot that receives all other game wagers, all players participating in the wagering game from whom the at least one game wager has been received may be eligible to win the game pot or a portion of the game pot. Players who are ineligible to win the poker pot, and players from whom fold indications have been received but from whom one or more other active wagers in play have been received, may be eligible to win the game pot or a portion of the game pot.

In some embodiments, the game pot may be seeded with money from the game pot rake account or a reserve account (as indicated at operation 718) at the beginning of play, after the game pot or a portion of the game pot has been awarded, or both. In some embodiments, a minimum account balance sufficient to cover expected losses is retained when distributing a progressive payout (operation 712) such that no seed money is required in the game pot. For example, the game pot may be seeded from the rake account of the house (operation 718), and the house may maintain an amount of funds in the rake account sufficient to significantly reduce (e.g., to essentially eliminate) the likelihood that any payouts made from the rake account and any seeding amounts withdrawn from the rake account exhaust or overdraw the rake account. In some embodiments, a casino reserve account may be provided to fill the rake account in the event of an overdraw. Such seeding may incentivize players to participate in the wagering game, and specifically to place a game wager (e.g., a progressive wager) to be eligible for the progressive payout from the game pot. In addition, such seeding may reduce the likelihood that the amount of funds in the game pot may be insufficient to cover all the payouts to players. For example, where a player hand achieves a premium winning hand composition in one round of play, a player hand achieves a predetermined winning hand combination in the immediately following round of play, and a fixed odds payout is to be awarded to the player holding the predetermined winning hand combination, the amount seeded to the game pot between those rounds of play may be at least as great as the maximum fixed odds payout awardable for any predetermined winning hand combination. The game pot may be seeded each time the game pot is awarded in its entirety or each time the amount in the game pot is lower than the maximum fixed odds payout.

As a specific, nonlimiting example, a player-banked wagering game with a player-pooled progressive configuration may comprise accepting a first player-pooled wager from each player and adding the first player-pooled ante wagers to a player-pooled pot which may be reflected by the presence of the chips or images of the chips grouped together with one another on the playing surface. The player-pooled pot may be a no-house-advantage pot that is awarded according to the game rules of the underlying wagering game. Any additional wagers (e.g., ante, bonus side wagers, other game play wagers, etc.) and added to another pot from which payouts from the game may be distributed. In addition, an optional jackpot wager that qualifies the player for eligibility to participate in at least a major progressive jackpot and in some embodiments also qualifies the player to participate in a minor jackpot event may be accepted. A random number generator 428 (FIGS. 4, 5, and 6) may be initiated to produce a random number. The random number may be utilized to determine whether a current round of game play is eligible for a major progressive jackpot 108 (FIG. 1). A determined probability that the current round of game play is eligible for the major progressive jackpot 108 may be inversely proportional to a probability of the jackpot trigger. In addition, the at least one player may be informed of whether or not the current round of game play is eligible for the major progressive jackpot 108 before initiation of the current round of game play. The underlying wagering game may be resolved according to the game rules. The major progressive jackpot 108 may be resolved and distributed responsive to the occurrence of the jackpot trigger when the gaming station 108 is determined to be eligible according to the eligibility probability.

Referring to FIG. 7B, shown is a flowchart diagram of a method 720 of administering a wagering game, which may be at least partially player-banked, according to a dividend refund embodiment. The method 720 is largely the same as the method 700 of the player-pooled progressive (FIG. 7A), with the exception that, rather than determining whether a progressive-winning condition has occurred (operation 710 (FIG. 7A)), the method 720 includes determining whether a trigger event condition has occurred, as indicated at operation 722, and, if so, distributing the game pot to one or more past or present players of the wagering game, as indicated at operation 724 (rather than distributing the game pot as a progressive payout as at operation 712 (FIG. 7A)). In such embodiment, the game pot may accumulate between rounds of play, and, to periodically reduce the balance, a dividend (e.g., a share of the game pot awarded to each participating player) may be awarded to players from the game pot. Thus, what would otherwise be the profits from lost wagers, less amounts raked by the house, are redistributed back to the players, rather than collected by the house as revenue. Thus, the distribution is not a payout on the underlying game, but a refund.

In embodiments where payouts from the game pot comprise dividend distributions, the game pot may be distributed among a plurality of players upon the occurrence of a predetermined event (referred to herein as a "trigger event"), as indicated at operation 722. The predetermined, trigger event may not be based, for example, on player skill or chance events occurring in the underlying wagering game. The predetermined trigger event may comprise, for example, determination that at least one player participated for a predetermined number of hands; completed a predetermined number of rounds of play at a given table, electronic gaming machine, or remote gaming device; reached a predetermined time limit since play commenced; or reached a predetermined amount within the game pot. The predetermined trigger event or condition may be time-based, pot-based (or pool-based), game-based, or other-based. Further details on pot distributions based on predetermined trigger events and conditions are disclosed in the U.S. patent application Ser. No. 13/871,824, filed Apr. 26, 2013, titled "Distributing Supplemental Pot in Wagering Games Based on Predetermined Event," the disclosure of which is incorporated herein in its entirety by this reference.

The dividend distributions may be divided at least among players currently participating in the wagering game. In some embodiments, the dividend distributions may also be paid to players who previously contributed to the game pot but who have since ceased participating in the wagering game. In some embodiments, the dividend distributions may not be paid to players from whom contributions to the game pot have not been received since the last dividend distribution was paid. The percentage of the game pot refunded to each player as a dividend distribution may be, for example, approximately equal to the percentage of hands won by each player, the percentage of first pot winnings won by each player based on game play, the percentage of total wager amounts received from each player, the proportional number of wagers received from each player, the proportional length of time spent playing the wagering game by each player, or an equal percentage for each player eligible to receive a dividend distribution from the game pot.

The dividend refund may be distributed in the form of a credit made to the receiving players' accounts. In some embodiments, the refund may be paid without concurrently alerting the player, though the refund may be noticeable when and if the player next checks his or her balance in her player account.

As a specific, non-limiting example, a player-pooled wagering game with a dividend refund configuration may include utilizing an account server to link a plurality of gaming stations to a major progressive jackpot. A player-pooled wager may be received from each player and the first player-pooled wagers to a player-pooled pot. Additional wages (e.g., ante, side wagers, etc.) may be received from each player and the other wagers may be added to another pot separate from the player-banked pot. A rake may be collected from the other pot and/or the player-pooled pot. An optional major progressive jackpot side wager may also be received for participation in the major progressive jackpot from one or more of the plurality of players at one or more of the plurality of gaming stations. A random number generator may be initiated to produce a random number. The player-pooled wagers may be resolved according a highest hand of the players of the wagering game. The other wager may be resolved according to game rules of the game play with payouts being distributed from the other pot. In addition, at least a portion of the other pot may be distributed among the players when a predetermined event has occurred. The optional progressive jackpot side wager may be resolved by utilizing the random number to determine whether a current round of game play is eligible for the major progressive jackpot and an occurrence of a jackpot trigger, wherein a determined jackpot winning probability has been normalized for each gaming station of the plurality of gaming stations by utilizing dissimilar eligibility probabilities for each gaming station participating in the major progressive jackpot.

In some embodiments, wagering games may be administered without players risking money in connection with the wagers (i.e., "play-for-fun" games). Access to play-for-fun wagering games may be granted on a time period basis in some embodiments. For example, upon initially joining the wagering game, each player may automatically be given wagering elements, such as, for example, chips, points, or simulated currency, that is of no redeemable value. After joining, the player may be permitted to place bets using the wagering elements and a timer may track how long the player has been participating in the wagering game. If the player exhausts his or her supply of the wagering elements before a predetermined period of time has expired, the player may be permitted to simply wait until the period of time passes to rejoin the game, at which time another quantity of the wagering elements may be distributed to the player to permit the player to resume participation in the wagering game.

In some embodiments, a hierarchy of players may determine the quantity of wagering elements given to a player for each predetermined period of time. For example, players who have been participating in the wagering game for a longer time, who have played closest to optimal strategy for the game, who have won the largest percentage of wagers, who have wagered the most in a play-for-pay environment, or who have won the largest quantities of wagering elements from their wagers may be given more wagering elements for each allotment of time than players who have newly joined, who have played according to poor strategy, who have lost more frequently, or who have lost larger quantities of wagering elements. In some embodiments, the hierarchy of players may determine the duration of each allotment of time. For example, players who have been participating in the wagering game for a longer time, who have played closest to optimal strategy for the game, who have won the largest percentage of wagers, or who have won the largest quantities of wagering elements from their wagers may be given shorter allotments of times to wait for an award of more wagering elements than players who have newly joined, who have played according to poor strategy, who have lost more frequently, or who have lost larger quantities of wagering elements. In some embodiments, players who have not run out of wagering elements after the period of time has expired may have the balance of their wagering elements reset for a subsequent allotment of time. In other embodiments, players who have not run out of wagering elements may be allowed to retain their remaining wagering elements for subsequent allotments of time, and may be given additional wagering elements corresponding to the new allotment of time to further increase the balance of wagering elements at their disposal. Players may be assigned to different categories of players, which determine the number of wagering elements awarded. In a given period of time, higher level players, or players who have invested more time playing the game may be allotted more wagering elements per unit of time than a player assigned to a lower level group.

Therefore, in some embodiments, the wagering game may be administered by receiving wagers (e.g., actual wagers may depend on the underlying wagering game) of no real-world monetary value, and payouts (e.g., actual payouts may depend on the underlying wagering game) may be paid without transferring real-world monetary value to the players. Such embodiments, referred to herein as "free play-for-fun" embodiments are nonetheless contemplated as modes of carrying out the methods described herein.

In some embodiments, referred to herein as "social play-for-fun" embodiments, a player may be permitted to redeem an access token of no redeemable face value, such as, for example, points associated with a player account (e.g., social media account credits, online points associated with a transacting account, etc.), to compress the period of time and receive more wagering elements. The access tokens may be sold or may be given without directly exchanging money for the access tokens. For example, access tokens may be allocated to players who participate in member events (e.g., complete surveys, receive training on how to play the wagering game, share information about the wagering game with others), spend time participating in the wagering game or in a player account forum (e.g., logged in to a social media account), or view advertising. Thus, an entity administering social play-for-fun wagering games may not receive money from losing player wagers or may not take a rake on wagers, but may receive compensation through advertising revenue or through the purchase of access tokens redeemable for time compressions to continue play of the wagering game or simply to increase the quantity of wagering elements available to a player.

After receipt of an indication that a player has stopped participating in a play-for-fun wagering game (e.g., a free play-for-fun embodiment, a social play-for-fun embodiment), any remaining quantities of the wagering elements may be relinquished by the player and retained by the administrator, in some embodiments. For example, receipt of an indication that the player has logged out of a play-for-fun wagering game administered over the Internet may cause any remaining wagering elements associated with a respective player to be lost. Thus, when the player rejoins the play-for-fun wagering game, the quantity of wagering elements given to the player for an allotment of time may not bear any relationship to the quantity of wagering elements held by the player when he or she quit playing a previous session of the wagering game. In other embodiments, upon receipt of an indication that a player has stopped playing, the quantity of wagering elements held by the player at that time may be retained and made available to the player, along with any additional quantities of wagering elements granted for new allotments of time, upon receipt of an indication that the player has rejoined the wagering game.

As a specific, nonlimiting example, a play-for fun wagering game may comprise allocating from a server 106 a quantity of valueless wagering elements to at least one player at a gaming station 102 (FIG. 1). The server 406 may receive authorization from the at least one player to allocate at least a portion of the valueless wagering elements to an optional side-wager. A RNG 428 (FIGS. 4, 5, and 6) may be initiated to produce a random number. The random number may be used to determine whether a current round of game play is eligible for a major progressive jackpot 108. The major progressive jackpot 108 may comprise valueless wagering elements. A determined probability that the current round of game play is eligible for the major progressive jackpot 108 may be inversely proportional to a probability of the jackpot trigger. The at least one player may be informed of whether or not the current round of game play is eligible for the major progressive jackpot before initiation of the current round of game play. The valueless wagering elements of the major progressive jackpot 108 may be transmitted to the at least one player responsive to occurrence of the jackpot trigger.

Figure 8:
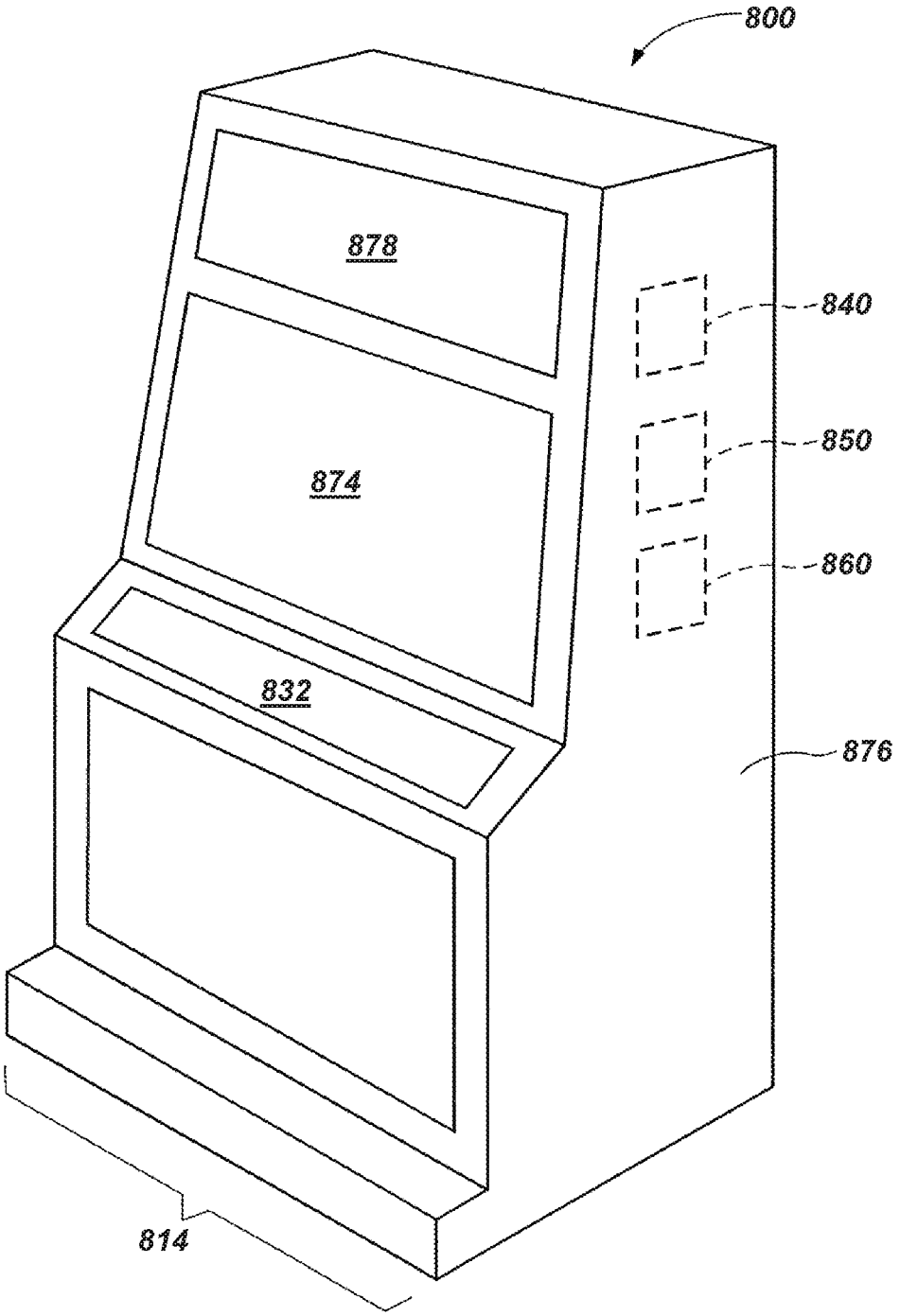
FIG. 8 is a perspective view of a single player electronic gaming device configured for implementation of embodiments of wagering games.

Referring to FIG. 8, illustrated is an example of an individual electronic gaming device 800 (e.g., an electronic gaming machine (EGM)) configured for implementation of embodiments of wagering games according to the present disclosure. The gaming station may comprise an individual electronic gaming device 800 that may include an individual player position 814 that includes a player input area 832 configured to enable a player to interact with the individual electronic gaming device 800 through various input devices (not shown). The individual electronic gaming device 800 may include a gaming screen 874 configured to display indicia for interacting with the individual electronic gaming device 800, such as through processing one or more programs stored in memory 840 to implement the rules of game play at the individual electronic gaming device 800. Accordingly, game play may be accommodated without involving physical playing cards, poker chips, and/or live personnel. The action may instead be simulated by a control processor 850 operably coupled to the memory 840 and interacting with and controlling the individual electronic gaming device 800.

Although the figure has an outline of a traditional gaming cabinet, the individual electronic gaming device 800 may be implemented in any number of ways, including, but not limited to, client software downloaded to a portable device, such as a smart phone, tablet, or laptop personal computer. The individual electronic gaming device 800 may also be a non-portable personal computer (e.g., a desktop or all-in-one computer) or other computing device. In some embodiments, client software is not downloaded but is native to the device or is otherwise delivered with the device when distributed to a player.

A communication device 860 may be included and operably coupled to the processor such that information related to operation of the individual electronic gaming device 800, information related to the game play, or combinations thereof may be communicated between the individual electronic gaming device 800 and other devices (not shown) through a suitable communication media, such, as, for example, wired networks, Wi-Fi networks, and cellular communication networks.

The gaming screen 874 may be carried by a generally vertically extending cabinet 876 of the individual electronic gaming device 800. The individual electronic gaming device 800 may further include banners (not shown) configured to communicate rules of game play and/or the like, such as along a top portion 878 of the cabinet 876 of the individual electronic gaming device 800. The individual electronic gaming device 800 may further include additional decorative lights (not shown), and speakers (not shown) for transmitting and/or receiving sounds during game play. Further detail of an example of an individual electronic gaming device 800 (as well as other embodiments of tables and devices) is disclosed in U.S. patent application Ser. No. 13/215,156, filed Aug. 22, 2011, published as U.S. Patent Publication No. 2013/0053117 on Feb. 28, 2013, and titled "Methods of Managing Play of Wagering Games and Systems for Managing Play of Wagering Games," the disclosure of which is incorporated herein in its entirety by this reference.

Some embodiments may be implemented at locations that include a plurality of player stations. Such player stations may include an electronic display screen for display of game information, such as displaying virtual cards, virtual chips, and game instructions, and for accepting wagers and facilitating credit balance adjustments. Such player stations may, optionally, be integrated in a table format, may be distributed throughout a casino or other gaming site, or may include both grouped and distributed player stations. While some features may be automated through electronic interfaces (e.g., virtual cards, virtual chips, etc.), some features may remain in the physical domain. As such, the game play may be administered by a live dealer, a virtual dealer, or a combination of both.

Figure 9:
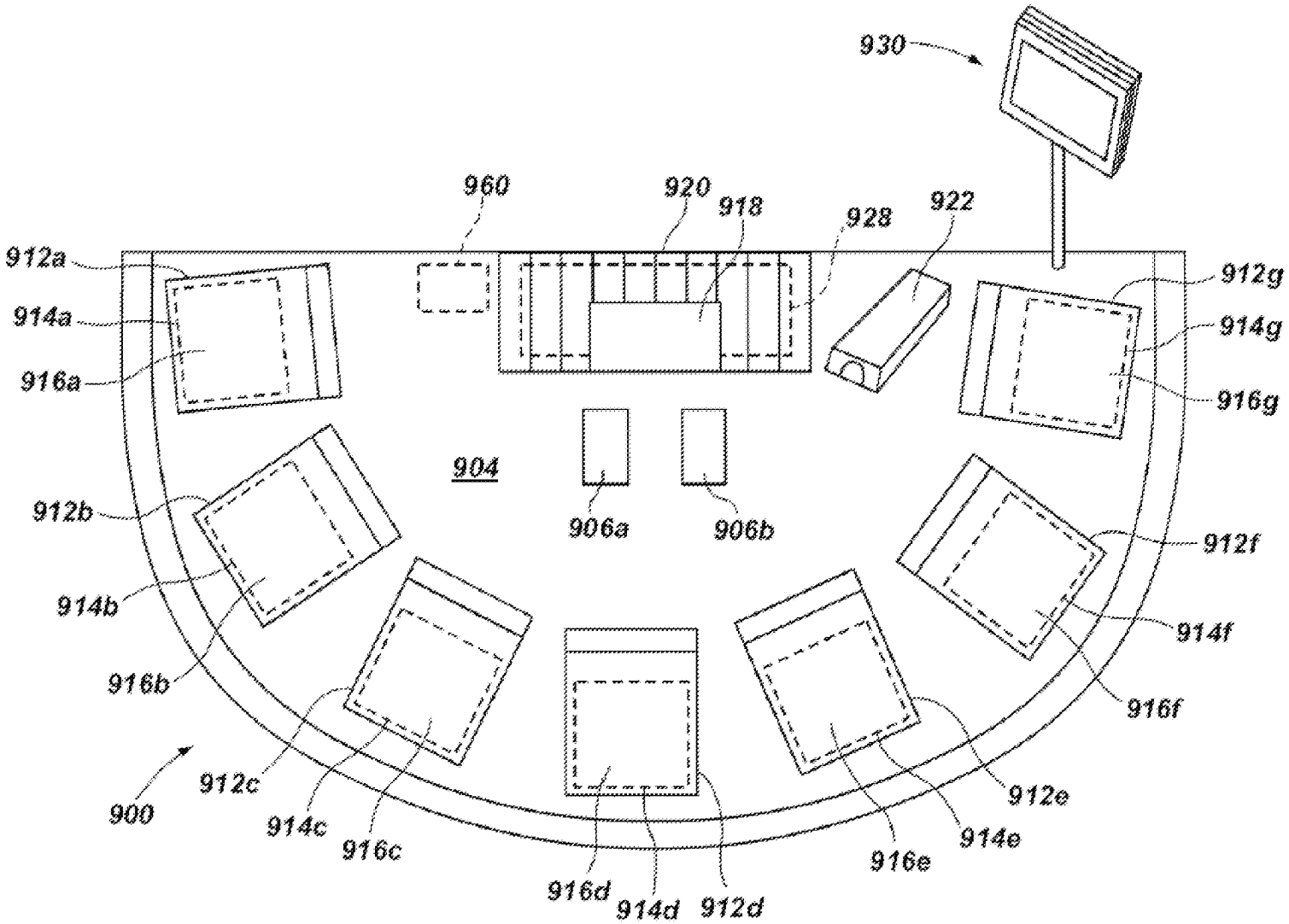
FIG. 9 is a top view of a suitable table configured for implementation of embodiments of wagering games, the table having electronic player wagering interfaces.

Referring to FIG. 9, systems and methods of the present disclosure may be implemented on a gaming table with electronic player interfaces. An example of a suitable table 900 configured for implementation of embodiments of wagering games according to the present disclosure is shown. The table 900 may include a playing surface 904. The table 900 may include a plurality of player stations 912*a* through 912*g*. Each player station 912*a* through 912*g* may include a player interface 916*a* through 916*g*, which may be used for displaying game information (e.g., game instructions, input options, wager information including virtual chips, game outcomes, etc.). The player interface 916*a* through 916*g* may include a display screen in the form of a touch screen, which may be at least substantially flush with the playing surface 904 in some embodiments. Each player interface 916*a* through 916*g* may be coupled respectively with its own local game processor 914*a* through 914*g* (shown in dashed lines), although, in some embodiments, a central game processor 928 (shown in dashed lines) may be employed and may communicate directly to player interfaces 916*a* through 916*g*. In some embodiments, a combination of individual local game processors 914*a* through 914*g* and the central game processor 928 may be employed.

A communication device 960 may be included and may be operably coupled to one or more of the local game processors 914, the central game processor 928, or combinations thereof, such that information related to operation of the table 900, information related to the game play, or combinations thereof may be communicated between the table 900 and other devices (not shown) through a suitable communication media, such as, for example, wired networks, Wi-Fi networks, and cellular communication networks.

The table 900 may further include additional features, such as a dealer chip tray 920, which may be used by the dealer to cash players in and out of the wagering game, whereas wagers and balance adjustments during game play may be performed using virtual chips. For embodiments using physical cards 906*a*, 906*b*, the table 900 may further include a card-handling device 922 that may be configured to shuffle, read, and deliver physical cards for the dealer and players to use during game play or, alternatively, a card shoe configured to read and deliver cards that have already been randomized. For embodiments using virtual cards, such virtual cards may be displayed at the individual player interfaces 916*a* through 916*g*. Common virtual cards may be displayed in a common card area (not shown).

The table 900 may further include a dealer interface 918, which, like the player interfaces 916*a* through 916*g*, may include touch screen controls for assisting the dealer in administering the wagering game. The table 900 may further include an upright display 930 configured to display images that depict game information such as pay tables, hand counts, historical win/loss information by player, and a wide variety of other information considered useful to the players. The upright display 930 may be double sided to provide such information to players as well as to the casino pit.

Further detail of an example of a table and player displays is disclosed in U.S. Patent Application Publication No. 2010/0016050, filed Jul. 15, 2008, published Jan. 21, 2010, now U.S. Pat. No. 8,262,475, issued Sep. 11, 2012, and now titled "Chipless Table Split Screen Feature," the disclosure of each of which application and patent is incorporated herein in its entirety by this reference. Although an embodiment is described showing individual discrete player stations, in some embodiments, the entire playing surface 904 may be an electronic display that is logically partitioned to permit game play from a plurality of players for receiving inputs from, and displaying game information to, the players, the dealer, or both.

Figure 10:
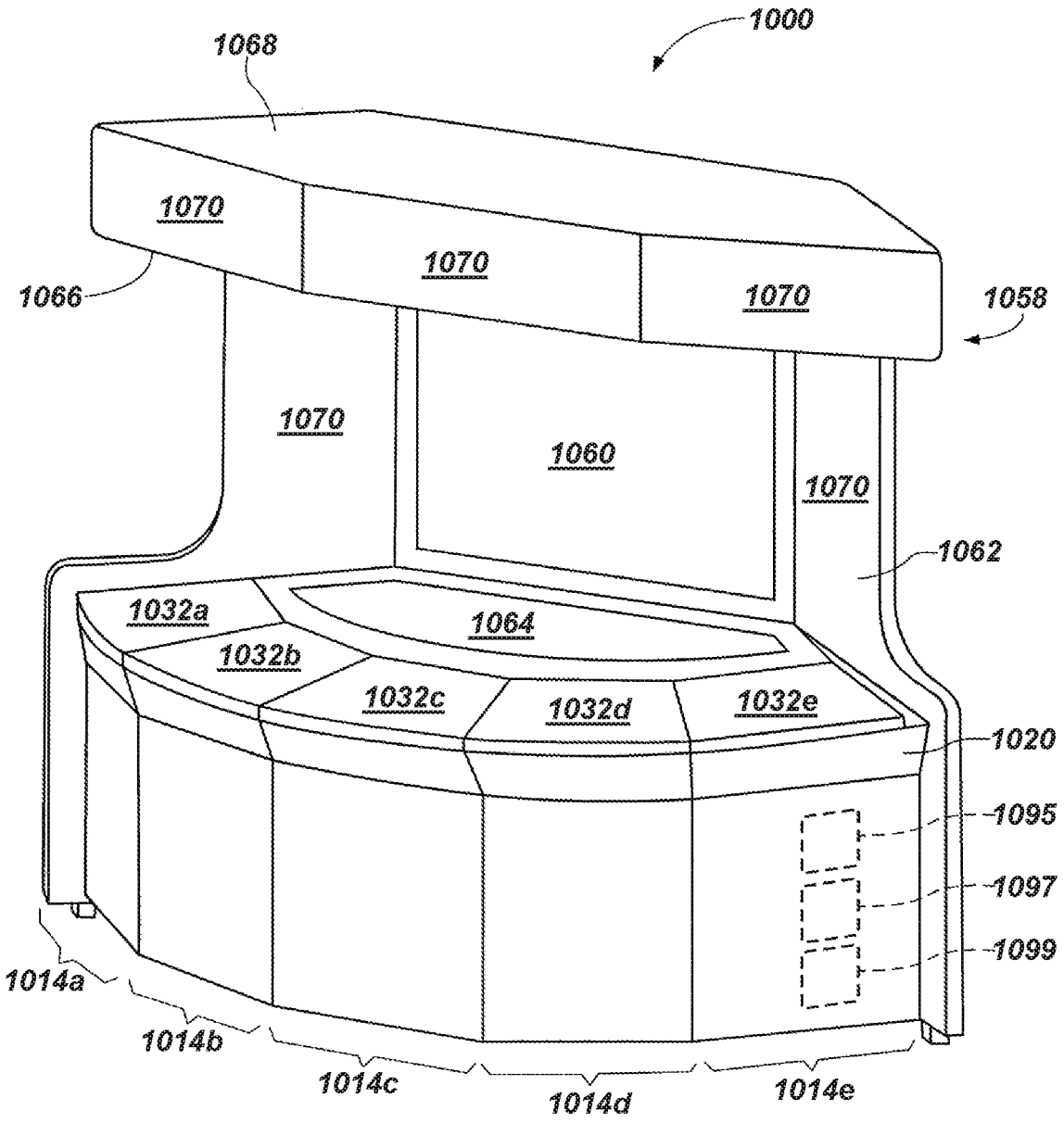
FIG. 10 is a perspective view of another embodiment of a suitable table configured for implementation of embodiments of wagering games having a virtual dealer.

Referring to FIG. 10, methods and systems of the present disclosure may be implemented on a multiple player electronic game platform. As shown in the Figure, another example of a suitable table 1000 configured for implementation of embodiments of wagering games having a virtual dealer according to the present disclosure is shown. Other embodiments may not include a virtual dealer but instead display dealer hand information but not a representation of a dealer. The table 1000 may include player positions 1014*a* through 1014*e* that are arranged in a bank about an arcuate edge 1020 of a video device 1058 that may comprise a card screen 1064 and a dealer screen 1060. The dealer screen 1060 may display a video simulation of the dealer (i.e., a virtual dealer) for interacting with the video device 1058, such as through processing one or more stored programs stored in memory 1095 to implement the rules of game play at the video device 1058. The dealer screen 1060 may be carried by a generally vertically extending cabinet 1062 of the video device 1058. The card screen 1064 may be configured to display at least one or more of the dealer's cards, community cards, and/or player's cards by the virtual dealer on the dealer screen 1060 (virtual dealer not shown in FIG. 10).

Each of the player positions 1014*a* through 1014*e* may include a player interface area 1032*a* through 1032*e* that is configured for wagering and game play interactions with the video device 1058 and/or virtual dealer. Accordingly, game play may be accommodated without involving physical playing cards, poker chips, and/or live personnel. The action may instead be simulated by a control processor 1097 interacting with and controlling the video device 1058. The control processor 1097 may be located internally within, or otherwise proximate to, the video device 1058. The control processor 1097 may be programmed, by known techniques, to implement the rules of game play at the video device 1058. As such, the control processor 1097 may interact and communicate with display/input interfaces and data entry inputs for each player interface area 1032*a* through 1032*e* of the video device 1058. Other embodiments of tables and gaming devices may include a control processor that may be similarly adapted to the specific configuration of its associated device.

A communication device 1099 may be included and operably coupled to the control processor 1097 such that information related to operation of the table 1000, information related to the game play, or combinations thereof may be communicated between the table 1000 and other devices (not shown) through a suitable communication media, such, as, for example, wired networks, Wi-Fi networks, and cellular communication networks.

The video device 1058 may further include banners (not shown) configured to communicate rules of play and/or the like, which may be located along one or more walls 1070 of the cabinet 1062. The video device 1058 may further include additional decorative lights (not shown) and speakers (not shown), which may be located on an underside surface 1066, for example, of a generally horizontally depending top 1068 of the cabinet 1062 of the video device 1058 generally extending toward the player positions 1014*a* through 1014*e*.

Further detail of an example of a table and player displays is disclosed in U.S. patent application Ser. No. 10/764,995, filed Jan. 26, 2004, published as U.S. Patent Application Publication No. 2005/0164762 on Jul. 28, 2005, now U.S. Pat. No. 8,272,958, issued Sep. 25, 2012, and titled "Automated Multiplayer Game Table with Unique Image Feed of Dealer," the disclosure of each of which application and patent is incorporated herein in its entirety by this reference. Although an embodiment is described showing individual discrete player stations, in some embodiments, the entire playing surface (e.g., player interface areas 1032*a* through 1032*e*, card screen 1064, etc.) may be an electronic display that is logically partitioned to permit game play from a plurality of players for receiving inputs from, and displaying game information to, the players, the dealer, or both.

Figure 11:
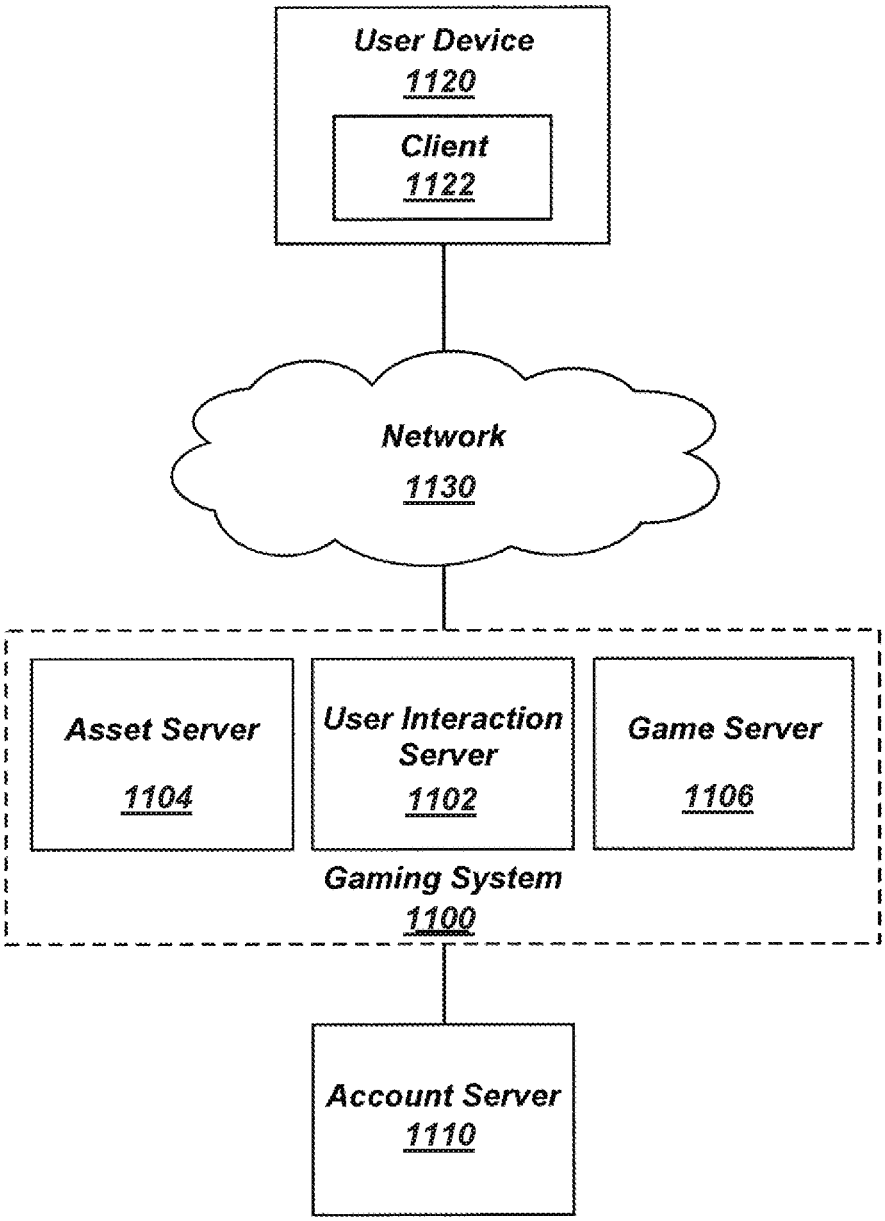
FIG. 11 is a schematic block diagram of a gaming system for implementing online embodiments of wagering games.

Wagering games in accordance with embodiments of the disclosure may be administered over the Internet, or otherwise online, in one embodiment using a gaming system employing a client server architecture. Referring to FIG. 11, illustrated is a schematic block diagram of a gaming system 1100 for implementing wagering games according to an embodiment of the present disclosure. The gaming system 1100 enables end users operating user device 1120 to access proprietary and/or non-proprietary game content. Such game content may include, without limitation, various types of wagering games such as card games, dice games, big wheel games, roulette, scratch off games ("scratchers"), and any other wagering game where the game outcome is determined, in whole or in part, by one or more random events. This includes, but is not be limited to, Class II and Class III games as defined under 25 U.S.C. § 2701 et seq. ("Indian Gaming Regulatory Act"). Such games may include banked and/or non-banked games.

The wagering games supported by the gaming system 1100 may be operated with real currency or with virtual credits or other virtual (e.g., electronic) value indicia. For example, the real currency option may be used with traditional casino and lottery-type wagering games in which money or other items of value are wagered and may be cashed out at the end of a game session. The virtual credits option may be used with wagering games in which credits (or other symbols) may be issued to a player to be used for the wagers. A player may be credited with credits in any way allowed, including, but not limited to, a player purchasing credits; being awarded credits as part of a contest or a win event in this or another game (including non-wagering games); being awarded credits as a reward for use of a product, casino, or other enterprise, time played in one session, or games played; or may be as simple as being awarded virtual credits upon logging in at a particular time or with a particular frequency, etc. Although credits may be won or lost, the ability of the player to cash out credits may be controlled or prevented. In one example, credits acquired (e.g., purchased or awarded) for use in a play-for-fun game may be limited to non-monetary redemption items, awards, or credits usable in the future or for another game or gaming session. The same credit redemption restrictions may be applied to some or all of credits won in a wagering game as well.

An additional variation includes web-based sites having both play-for-fun and wagering games, including issuance of free (non-monetary) credits usable to play the play-for-fun games. This may attract players to the site and to the games before they engage in wagering. In some embodiments, a limited number of free or promotional credits may be issued to entice players to play the games. Another method of issuing credits includes issuing free credits in exchange for identifying friends who may want to play. In another embodiment, additional credits may be issued after a period of time has elapsed to encourage the player to resume playing the game. The gaming system 1100 may enable players to buy additional game credits to allow the player to resume play. Objects of value may be awarded to play-for-fun players, which may or may not be in a direct exchange for credits. For example, a prize may be awarded or won for a highest scoring play-for-fun player during a defined time interval. All variations of credit redemption are contemplated, as desired by game designers and game hosts (the person or entity controlling the hosting systems).

The gaming system 1100 may include a gaming platform that establishes a portal for an end user to access a wagering game hosted by a game server 1106 through a user interaction server 1102. The user device 1120 may communicate with a user interaction server 1102 of the gaming system 1100 using a network 1130 (e.g., the Internet). The user interaction server 1102 may communicate with the game server 1106 and provide game information to the user. In some embodiments, the game server 1106 may also be a game engine. In some embodiments, a single user device communicates with a game provided by the game server 1106, while other embodiments may include a plurality of user devices 1120 configured to communicate and provide end users with access to the same game provided by the game server 1106. In addition, a plurality of end users may be permitted to access a single user interaction server 1102, or a plurality of user interaction servers 1102, to access the game server 1106.

The user interaction server 1102 may communicate with the user device 1120 to enable access to the gaming system 1100. The user interaction server 1102 may enable a user to create and access a user account and interact with game server 1106. The user interaction server 1102 may enable users to initiate new games, join existing games, and interface with games being played by the user.

The user interaction server 1102 may also provide a client 1122 for execution on the user device 1120 for accessing the gaming system 1100. The client 1122 provided by the gaming system 1100 for execution on the user device 1120 can comprise a variety of implementations according to the user device 1120 and method of communication with the gaming system 1100. In one embodiment, the user device 1120 connects to the gaming system 1100 using a web browser, and the client 1122 executes within a browser window or frame of the web browser. In another embodiment, the client 1122 is a stand-alone executable on the user device 1120.

In one embodiment, the client 1122 may comprise a relatively small amount of script (e.g., JAVASCRIPT®), also referred to as a "script driver," including scripting language that controls an interface of the client 1122. The script driver may include simple function calls requesting information from the gaming system 1100. In other words, the script driver stored in the client 1122 may merely include calls to functions that are externally defined by, and executed by, the gaming system 1100. As a result, the client 1122 may be characterized as a "thin client." As that term is used herein, the client 1122 may be little more than a script player. The client 1122 may simply send requests to the gaming system 1100 rather than performing logic itself. The client 1122 receives player inputs, and the player inputs are passed to the gaming system 1100 for processing and executing the wagering game. In one embodiment, this includes providing specific graphical display information to client 1122 as well as game outcomes.

In other embodiments, the client 1122 comprises an executable file rather than a script. In that case, client 1122 may do more local processing than does a script driver, such as calculating where to show what game symbols upon receiving a game outcome from game server 1106 through user interaction server 1102. In one embodiment, it may be that portions of an asset server 1104 are loaded onto the client 1122 and are used by the client 1122 in processing and updating graphical displays. Due to security and integrity concerns, most embodiments will have the bulk of the processing of the game play performed in the gaming system 1100. However, some embodiments may include significant game processing by client 1122 when the client and user device 1120 are considered trustworthy or when there is reduced concern for security and integrity in the displayed game outcome. In most embodiments, it is expected that some form of data protection, such as end-to-end encryption, will be used when data is transported over network 1130. Network 1130 may be any network, including, but not limited to, the Internet.

In an embodiment where the client 1122 implements further logic and game control methodology beyond the thin client, the client 1122 may parse and define player interactions prior to passing the player interactions to the gaming system 1100. Likewise, when the client 1122 receives a gaming interaction from the gaming system 1100, the client 1122 may be configured to determine how to modify the display as a result of the gaming interaction. The client 1122 may also allow the player to change a perspective or otherwise interact with elements of the display that do not change aspects of the game.

The gaming system 1100 may include an asset server 1104, which may host various media assets (e.g., audio, video, and image files) that may be sent to the client 1122 for presenting the various wagering games to the end user. In other words, in this embodiment, the assets presented to the end user may be stored separately from the client 1122. In one embodiment, the client 1122 requests the assets appropriate for the game played by the user; in other embodiments, especially those using thin clients, just those assets that are needed for a particular display event will be sent by game server 1106 when the game server 1106 determines they are needed, including as few as one asset. In one example, the client 1122 may call a function defined at the user interaction server 1102 or asset server 1104, which may determine which assets are to be delivered to the client 1122 as well as how the assets are to be presented by the client 1122 to the end user. Different assets may correspond to the various clients that may have access to the game server 1106 or to different games to be played.

The game server 1106 is configured to perform game play methods and determine game play outcomes that are provided to the user interaction server 1102 to be transmitted to the user device 1120 for display on the end user's computer. For example, the game server 1106 may include game rules for one or more wagering games, such that the game server 1106 controls some or all of the game flow for a selected wagering game as well as the determined game outcomes. The game server 1106 may include pay tables and other game logic. The game server 1106 also performs random number generation for determining random game elements of the wagering game. In one embodiment, the game server 1106 is separated from the user interaction server 1102 by a firewall or other method of preventing unauthorized access to the game server 1106 from the general members of the network 1130.

The user device 1120 may present a gaming interface to the player and communicate the user interaction to the gaming system 1100. The user device 1120 may be any electronic system capable of displaying gaming information, receiving user input, and communicating the user input to the gaming system 1100. As such, the user device 1120 can be a desktop computer, a laptop, a tablet computer, a set-top box, a mobile device (including, but not limited to, a smart phone), a kiosk, a terminal, or another computing device. The user device 1120 operating the client 1122 may comprise an interactive electronic gaming system 800 (see FIG. 11), as described above. The client 1122 may be a specialized application or may be executed within a generalized application capable of interpreting instructions from an interactive gaming system, such as a web browser.

The client 1122 may interface with an end user through a web page or an application that runs on a device including, but not limited to, a smartphone, a tablet, or a general computer, or the client 1122 may be any other computer program configurable to access the gaming system 1100. The client 1122 may be illustrated within a casino webpage (or other interface) indicating that the client 1122 is embedded into a webpage, which is supported by a web browser executing on the user device 1120.

In one embodiment, the gaming system 1100 may be operated by different entities. The user device 1120 may be operated by a third party, such as a casino or an individual, that links to the gaming system 1100, which may be operated, for example, by a wagering game service provider. Therefore, in some embodiments, the user device 1120 and client 1122 may be operated by a different administrator than the operator of the game server 1106. In other words, the user device 1120 may be part of a third-party system that does not administer or otherwise control the gaming system 1100 or game server 1106. In another embodiment, the user interaction server 1102 and asset server 1104 are provided by a third-party system. For example, a gaming entity (e.g., a casino) may operate the user interaction server 1102 or user device 1120 to provide its customers access to game content managed by a different entity that may control game server 1106, amongst other functionality. In some embodiments, these functions are operated by the same administrator. For example, a gaming entity (e.g., a casino) may elect to perform each of these functions in-house, such as providing both the access to the user device 1120 and the actual game content and providing administration of the gaming system 1100.

The gaming system 1100 may communicate with one or more external account servers 1110, optionally through another firewall. For example, the gaming system 1100 itself may not directly accept wagers or issue payouts. That is, the gaming system 1100 may facilitate online casino gaming but may not be part of a self-contained online casino itself. Instead, the gaming system 1100 may facilitate the play of wagering games owned and controlled by a company offering games and gaming products and services, such as SHFL entertainment, Inc. Another entity (e.g., a casino or any account holder or financial system of record) may operate and maintain its external account servers 1110 to accept bets and make payout distributions. The gaming system 1100 may communicate with the account servers 1110 to verify the existence of funds for wagering and to instruct the account server 1110 to execute debits and credits.

In some embodiments, the gaming system 1100 may directly accept bets and make payout distributions, such as in the case where an administrator of the gaming system 1100 operates as a casino. As discussed above, the gaming system 1100 may be integrated within the operations of a casino rather than separating out functionality (e.g., game content, game play, credits, debits, etc.) among different entities. In addition, for play-for-fun wagering games, the gaming system 1100 may issue credits, take bets, and manage the balance of the credits according to the game outcomes, but the gaming system 1100 may not permit payout distributions or be linked to an account server 1110 that permits payout distributions. Such credits may be issued for free, through purchase, or for other reasons, without the ability for the player to cash out. Such play-for-fun wagering games may be administered on platforms that do not permit traditional gambling, such as to comply with jurisdictions that do not permit online gambling.

The gaming system 1100 may be configured in many ways, from a fully integrated single system to a distributed server architecture. The asset server 1104, the user interaction server 1102, the game server 1106, and the account server 1110 may be configured as a single, integrated system of code modules running on a single server or machine, where each of the servers is functionally implemented on a single machine. In such a case, the functionality described herein may not be implemented as separate code modules. The asset server 1104, the user interaction server 1102, the game server 1106, and the account server 1110 may also be implemented as a plurality of independent servers, each using its own code modules running on a separate physical machine, and may further include one or more firewalls between selected servers (depending on security needs). Each server could communicate over some kind of networked connection, potentially as varied as that described for network 1130. Further, each single server may be implemented as a plurality of servers with load balancing and scalability factors built into the embodiment. All such embodiments and variations are fully contemplated.

Additional features may be supported by the game server 1106, such as hacking and cheating detection, data storage and archival, metrics generation, messages generation, output formatting for different end user devices, as well as other features and operations. For example, the gaming system 1100 may include additional features and configurations as described in U.S. patent application Ser. No. 13/353,194, filed Jan. 18, 2012, and application Ser. No. 13/609,031, filed Sep. 10, 2012, both titled "Network Gaming Architecture, Gaming Systems, and Related Methods," the disclosures of which are incorporated herein in their entirety by this reference.

The network 1130 may enable communications between the user device 1120 and the gaming system 1100. A network (not shown) may also connect the gaming system 1100 and account server 1110, and, further, one or more networks (not shown) may interconnect one or more of the other servers shown collectively as the gaming system 1100. In one embodiment, the network 1130 uses standard communications technologies and/or protocols. Thus, the network 1130 can include links using technologies such as Ethernet, 802.11, worldwide interoperability for microwave access (WIMAX®), 3G, digital subscriber line (DSL), asynchronous transfer mode (ATM), INFINIBAND®, PCI Express Advanced Switching, etc. Similarly, the networking protocols used on the network 1130 can include multiprotocol label switching (MPLS), the transmission control protocol/Internet protocol (TCP/IP), the User Datagram Protocol (UDP), the hypertext transport protocol (HTTP), the simple mail transfer protocol (SMTP), the file transfer protocol (FTP), etc. The data exchanged over the network 1130 can be represented using technologies and/or formats including the hypertext markup language (HTML), the extensible markup language (XML), etc. In addition, all or some of the links can be encrypted using conventional encryption technologies such as secure sockets layer (SSL), transport layer security (TLS), virtual private networks (VPNs), Internet Protocol security (IPsec), etc. In another embodiment, the entities can use custom and/or dedicated data communications technologies instead of, or in addition to, the ones described above. Depending upon the embodiment, the network 1130 can include links comprising one or more networks such as the Internet.

In operation, an online gaming system may receive an instruction from a user device 1120 indicating a wager has been accepted in response to a player inputting an instruction to participate in a jackpot game. The player makes a wager that qualifies the player for at least play in a major jackpot. A random number is generated and a determination is made whether the game the player game station is eligible for a major progressive jackpot. In one example, the player game station is a virtual table game. The game is played, and if the game result is a predetermined winning major jackpot outcome, the player wins the major progressive jackpot.

Figure 12:
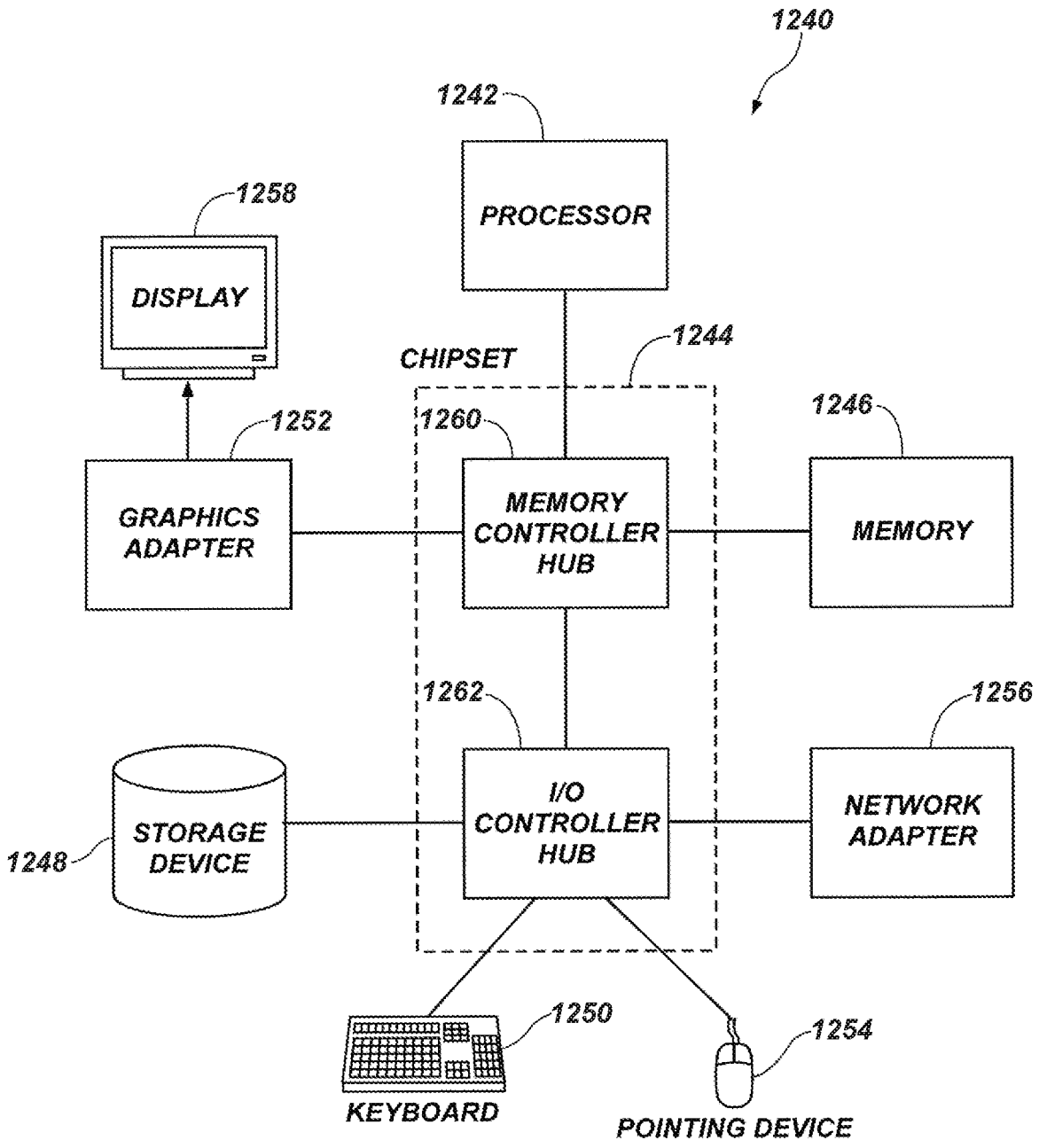
FIG. 12 is a block diagram of a computer for acting as a gaming system according to some embodiments.

Referring to FIG. 12, a high-level block diagram of a computer system 1240 for acting as the gaming system 1100 (see FIG. 11) according to one embodiment is shown. Illustrated are at least one processor 1242 coupled to a chipset 1244, as indicated in dashed lines. Also coupled to the chipset 1244 are memory 1246, a storage device 1248, a keyboard 1250, a graphics adapter 1252, a pointing device 1254, and a network adapter 1256. A display 1258 is coupled to the graphics adapter 1252. In one embodiment, the functionality of the chipset 1244 is provided by a memory controller hub 1260 and an I/O controller hub 1262. In another embodiment, the memory 1246 is coupled directly to the processor 1242 instead of to the chipset 1244.

The storage device 1248 is any non-transitory computer-readable storage medium, such as a hard drive, a compact disk read-only memory (CD-ROM), a DVD, or a solid-state memory device (e.g., a flash drive). The memory 1246 holds instructions and data used by the processor 1242. The pointing device 1254 may be a mouse, a track pad, a track ball, or another type of pointing device, and it is used in combination with the keyboard 1250 to input data into the computer system 1240. The graphics adapter 1252 displays images and other information on the display 1258. The network adapter 1256 couples the computer system 1240 to a local or wide area network.

As is known in the art, the computer system 1240 can have different and/or other components than those shown in FIG. 12. In addition, the computer system 1240 can lack certain illustrated components. In one embodiment, the computer system 1240 acting as the gaming system 1100 (FIG. 11) lacks the keyboard 1250, pointing device 1254, graphics adapter 1252, and/or display 1258. Moreover, the storage device 1248 can be local and/or remote from the computer system 1240 (such as embodied within a storage area network (SAN)). Moreover, other input devices, such as, for example, touch screens may be included.

The network adapter 1256 (may also be referred to herein as a communication device) may include one or more devices for communicating using one or more of the communication media and protocols discussed above with respect to FIG. 11.

In addition, some or all of the components of this general computer system 1240 of FIG. 12 may be used as part of the processor and memory discussed above with respect to the systems of FIGS. 4, 5 and 6.

The gaming system 1100 (FIG. 11) may comprise several such computer systems 1240. The gaming system 1100 may include load balancers, firewalls, and various other components for assisting the gaming system 1100 to provide services to a variety of user devices.

As is known in the art, the computer system 1240 is adapted to execute computer program modules for providing functionality described herein. As used herein, the term "module" refers to computer program logic utilized to provide the specified functionality. Thus, a module can be implemented in hardware, firmware, and/or software. In one embodiment, program modules are stored on the storage device 1248, loaded into the memory 1246, and executed by the processor 1242.

Embodiments of the entities described herein can include other and/or different modules than the ones described here. In addition, the functionality attributed to the modules can be performed by other or different modules in other embodiments. Moreover, this description occasionally omits the term "module" for purposes of clarity and convenience.

Some portions of the disclosure are presented in terms of algorithms (e.g., as represented in flowcharts, prose descriptions, or both) and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps (instructions) leading to a desired result. The steps are those requiring physical manipulations of physical quantities. Usually, though not necessarily, these quantities take the form of electrical, magnetic, or optical signals capable of being stored, transferred, combined, compared, and otherwise manipulated. It is convenient at times, principally for reasons of common usage, to refer to these signals as bits, values, elements, symbols, characters, terms, numbers, or the like. Furthermore, it is also convenient at times to refer to certain arrangements of steps requiring physical manipulations or transformation of physical quantities or representations of physical quantities as modules or code devices, without loss of generality.

However, all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing," "computing," "calculating," "determining," "displaying," "determining," or the like, refer to the action and processes of a computer system, or similar electronic computing device (such as a specific computing machine), that manipulates and transforms data represented as physical (electronic) quantities within the computer system memories or registers or other such information storage, transmission, or display devices.

Certain aspects of the embodiments include process steps and instructions described herein in the form of an algorithm. It should be noted that the process steps and instructions of the embodiments can be embodied in software, firmware, or hardware, and, when embodied in software, could be downloaded to reside on and be operated from different platforms used by a variety of operating systems. The embodiments can also be in a computer program product that can be executed on a computing system.

Some embodiments also relate to an apparatus for performing the operations herein. Such an apparatus may be specially constructed for the purposes, e.g., a specific computer, or it may comprise a general-purpose computer selectively activated or reconfigured by a computer program stored in the computer. Such a computer program may be stored in a computer-readable storage medium, such as, but is not limited to, any type of disk including floppy disks, optical disks, CD-ROMs, magnetic-optical disks, read-only memories (ROMs), random access memories (RAMs), EPROMs, EEPROMs, magnetic or optical cards, application specific integrated circuits (ASICs), or any type of media suitable for storing electronic instructions, and each coupled to a computer system bus. Memory can include any of the above and/or other devices that can store information/data/programs and can be a transient or non-transient medium, where a non-transient or non-transitory medium can include memory/storage that stores information for more than a minimal duration. Furthermore, the computers referred to in the specification may include a single processor or may be architectures employing multiple processor designs for increased computing capability.

The algorithms and displays presented herein are not inherently related to any particular computer or other apparatus. Various general-purpose systems may also be used with programs in accordance with the teachings herein, or it may prove convenient to construct more specialized apparatus to perform the method steps. The structure for a variety of these systems will appear from the description herein. In addition, the embodiments are not described with reference to any particular programming language. It will be appreciated that a variety of programming languages may be used to implement the teachings of the embodiments as described herein, and any references herein to specific languages are provided for the purposes of enablement and best mode.

While certain illustrative embodiments have been described in connection with the figures, those of ordinary skill in the art will recognize and appreciate that embodiments encompassed by the disclosure are not limited to those embodiments explicitly shown and described herein. Rather, many additions, deletions, and modifications to the embodiments described herein may be made without departing from the scope of embodiments encompassed by the disclosure, such as those hereinafter claimed, including legal equivalents. In addition, features from one disclosed embodiment may be combined with features of another disclosed embodiment while still being within the scope of the disclosure, as contemplated by the inventors.

What is claimed is:

1. A method for operating a progressive jackpot system, the method comprising:

linking, with a processor, at least two gaming tables to a major progressive jackpot;

administering at least two different wagering games that have different jackpot trigger probabilities for achieving a jackpot trigger for the major progressive jackpot on the at least two gaming tables; and normalizing a major jackpot winning probability based, at least in part, on the different jackpot trigger probabilities such that the major jackpot winning probability for players of the at least two different wagering games is substantially the same by:

assigning a first eligibility probability to the first wagering game of the at least two different wagering games for each current round of a first gaming table administering the first wagering game to be eligible to participate in the major progressive jackpot;

assigning a second eligibility probability to a second wagering game of the at least two different wagering games for each current round of a second gaming table to be eligible to participate in the major progressive jackpot; and randomly determining whether at least one of the first gaming table and the second gaming table is eligible to participate in a major progressive jackpot during each of their respective current rounds based, at least in part, on the different jackpot trigger probabilities;

wherein randomly determining whether at least one of the first gaming table and the second gaming table is eligible to participate in the major progressive jackpot comprises:

initiating a random number generator to produce a random number responsive to a request from at least one of the first gaming table and the second gaming table; and comparing the random number with a subset of a range of numbers that corresponds with the corresponding eligibility probability.

2. The method of claim 1, further comprising displaying eligibility of at least one of the first gaming table and the second gaming table if selected for participation in the major progressive jackpot.

3. The method of claim 2, further comprising receiving at least one wager to participate in at least the major progressive jackpot, wherein displaying eligibility occurs after receiving the at least one wager.

4. The method of claim 1, wherein the request is responsive to a dealer manually requesting the random number.

5. The method of claim 1, wherein the request is an automatic request responsive to sensing a major progressive jackpot side wager being placed by a player.

6. The method of claim 1, wherein assigning a first eligibility probability and a second eligibility probability include a resulting major jackpot winning probability for each of the first wagering game and the second wagering game to be substantially equal.

7. The method of claim 1, further comprising providing the at least two gaming tables.

8. The method of claim 1, further comprising:

presenting a regular pay table not including the major progressive jackpot responsive to determining that the current round of game play is not eligible for the major progressive jackpot; and presenting a major progressive jackpot pay table including the major progressive jackpot responsive to determining that the current round of game play is eligible for the major progressive jackpot.

9. A method for operating a progressive jackpot system, the method comprising:

linking, with a processor, at least two gaming stations to a progressive jackpot each providing a different wagering game having a progressive jackpot outcome with different progressive jackpot trigger probabilities; and normalizing a progressive jackpot winning probability for the different wagering games based, at least in part, on the different progressive jackpot trigger probabilities such that the progressive jackpot winning probability for players of the different wagering games is substantially the same by:

assigning a first eligibility probability to a first wagering game of the different wagering games for each current round of a first gaming station to be eligible to participate in the progressive jackpot;

assigning a second eligibility probability to a second wagering game of the different wagering games for each current round of a second gaming station to be eligible to participate in the progressive jackpot; and randomly determining whether at least one of the first gaming station and the second gaming station is eligible to participate in a progressive jackpot during each of their respective current rounds;

wherein randomly determining whether at least one of the first gaming station and the second gaming station is eligible to participate in the progressive jackpot during each of their respective current rounds comprises:

initiating a random number generator to produce a random number responsive to a request from at least one of the first gaming station and the second gaming station; and comparing the random number with a subset of a range of numbers that corresponds with the corresponding eligibility probability.

10. The method of claim 9 comprising providing the at least two gaming stations as gaming tables.

* * * * *